US006945722B2

(12) United States Patent
Colburn et al.

(10) Patent No.: US 6,945,722 B2
(45) Date of Patent: Sep. 20, 2005

(54) COMBINATION TIRE SIDEWALL PROTECTANT DISPENSER AND APPLICATOR

(75) Inventors: Todd Colburn, La Jolla, CA (US); Frederick Large, Carlsbad, CA (US); Brooke T. Baxter, New Milford, CT (US); Wen-Chen Su, Lexington, KY (US); Dan Anderson, Carlsbad, CA (US); William R. Bucknam, Jr., Woodbury, CT (US)

(73) Assignee: The Valvoline Company, a division of Ashland, Inc., Lexington, KY (US)

( * ) Notice: Subject to any disclaimer, the term of this patent is extended or adjusted under 35 U.S.C. 154(b) by 66 days.

(21) Appl. No.: 10/437,658

(22) Filed: May 14, 2003

(65) Prior Publication Data

US 2004/0228670 A1 Nov. 18, 2004

(51) Int. Cl.[7] ..... A46B 11/00; B43K 5/00; B43M 11/06

(52) U.S. Cl. ..... 401/11; 401/205; 401/186

(58) Field of Search ..... 401/9, 11, 183–186, 401/203–207

(56) References Cited

U.S. PATENT DOCUMENTS 1,287,487 A 12/1918 Smith
1,565,608 A 12/1925 Walsh, Jr.
1,678,962 A 7/1928 Stark et al.
1,972,318 A 9/1934 Rosenberg
2,147,769 A 2/1939 Epstein
2,281,367 A * 4/1942 Moll ..... 401/272
2,377,837 A 6/1945 Zimmerman
2,820,234 A * 1/1958 Rigney ..... 401/186
2,946,154 A 7/1960 Bornemann
3,006,023 A 10/1961 Worthington
3,324,855 A 6/1967 Heimlich (Continued)

OTHER PUBLICATIONS

Photograph Copy—Quick N' Neat Liquid Wax Applicator, Clean Shot Products, Inc. , Emporia, KS 66801—(5 pages).

*Primary Examiner*—David J. Walczak
(74) *Attorney, Agent, or Firm*—Fulwider Patton Lee & Utecht LLP

(57) ABSTRACT

A tire applicator for applying treatment fluid to sidewall of a vehicle tire, which is constructed with an applicator head including a dispenser housing having a bottom distribution plate and an applicator pad affixed thereto, and which may be configured to complementally and releasably receive an associated container.

37 Claims, 10 Drawing Sheets

U.S. PATENT DOCUMENTS

| | | | | | |
|---|---|---|---|---|---|
| 3,418,059 | A | | 12/1968 | Robe | |
| 3,876,314 | A | | 4/1975 | Nehring | |
| 4,035,090 | A | | 7/1977 | Bavaveas | |
| D245,390 | S | | 8/1977 | Hoyt | |
| 4,084,910 | A | | 4/1978 | LaRosa | |
| 4,148,318 | A | | 4/1979 | Meyer | |
| 4,183,684 | A | | 1/1980 | Avery, Jr. | |
| 4,225,254 | A | | 9/1980 | Holberg et al. | |
| 4,601,081 | A | | 7/1986 | Sutton et al. | |
| 4,762,433 | A | | 8/1988 | Bergeson et al. | |
| 4,779,386 | A | | 10/1988 | Harris | |
| 4,822,194 | A | * | 4/1989 | Simonette | 401/207 |
| 4,925,327 | A | * | 5/1990 | Wirt | 401/205 |
| 4,983,061 | A | | 1/1991 | Demarest | |
| 5,064,306 | A | | 11/1991 | Gueret | |
| 5,122,056 | A | | 6/1992 | Barbee | |
| 5,159,735 | A | | 11/1992 | Owens et al. | |
| 5,299,877 | A | * | 4/1994 | Birden | 401/206 |
| 5,307,847 | A | | 5/1994 | Pavenick et al. | |
| 5,397,194 | A | | 3/1995 | Yuan et al. | |
| 5,452,961 | A | | 9/1995 | Lu | |
| 5,454,659 | A | * | 10/1995 | Vosbikian et al. | 401/207 |
| 5,597,255 | A | | 1/1997 | Yager et al. | |
| 5,755,241 | A | | 5/1998 | Cheung | |
| 5,775,826 | A | | 7/1998 | Miller | |
| 5,791,801 | A | | 8/1998 | Miller | |
| D405,572 | S | | 2/1999 | Bouchez | |
| 5,896,616 | A | | 4/1999 | Large | |
| 5,904,433 | A | | 5/1999 | Kay | |
| D416,653 | S | | 11/1999 | Silvers | |
| 5,987,694 | A | | 11/1999 | Large | |
| 6,010,268 | A | | 1/2000 | Sereg et al. | |
| 6,035,806 | A | | 3/2000 | Lorenzo | |
| 6,092,952 | A | | 7/2000 | Eberle | |
| 6,095,705 | A | | 8/2000 | Phillips | |
| 6,135,659 | A | | 10/2000 | Ku | |
| D434,525 | S | | 11/2000 | Angeletta | |
| 6,371,675 | B1 | | 4/2002 | Hoang et al. | |
| 6,425,701 | B1 | | 7/2002 | Jacobs | |
| D461,279 | S | | 8/2002 | Angeletta | |
| 6,485,212 | B1 | * | 11/2002 | Bomgaars et al. | 401/11 |
| 6,533,484 | B1 | * | 3/2003 | Osei et al. | 401/205 |
| 6,547,471 | B1 | | 4/2003 | Tucker et al. | |
| 2003/0081983 | A1 | | 5/2003 | Waddell | |

* cited by examiner

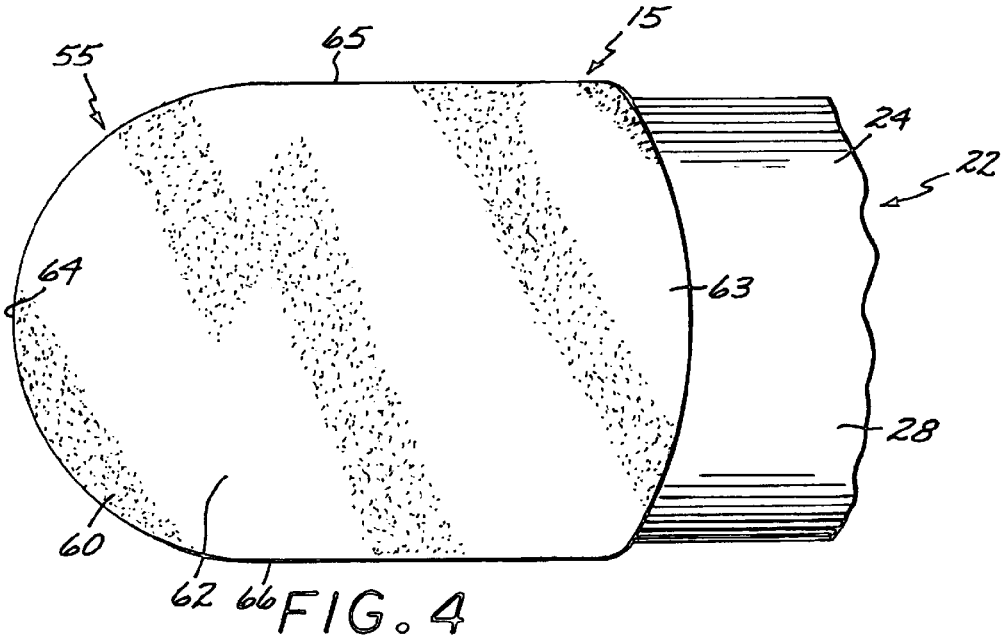
FIG. 4
FIG. 5
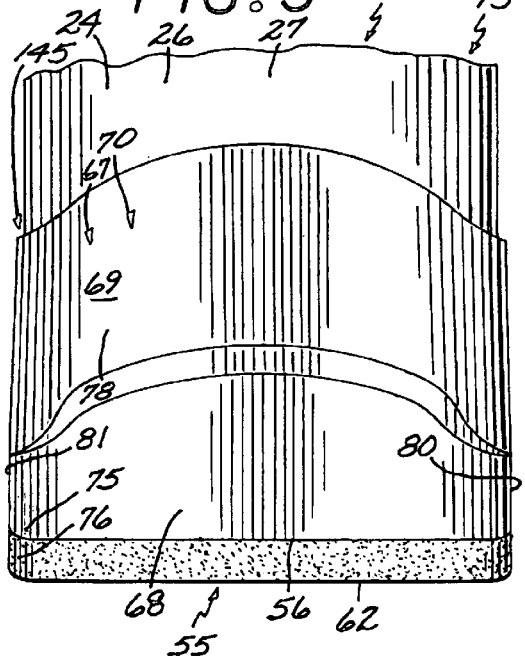
FIG. 6
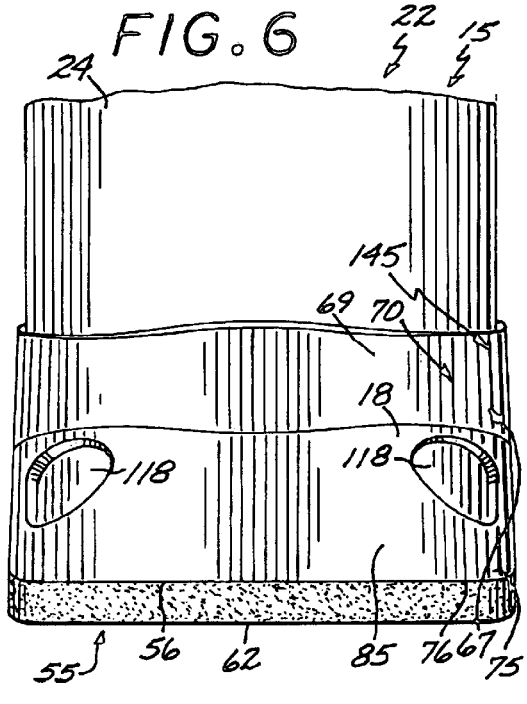

FIG. 9
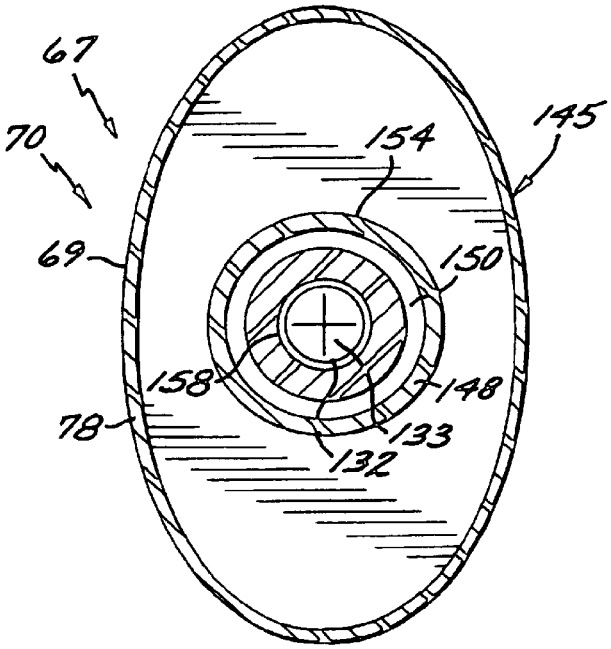
FIG. 10
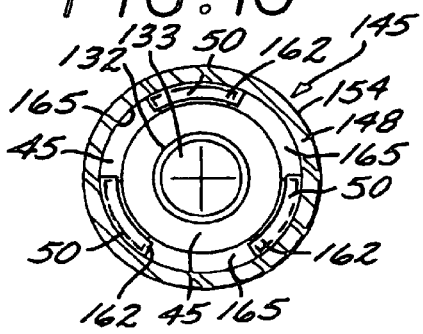
FIG. 11
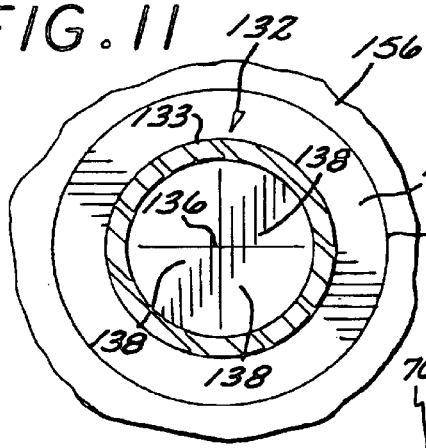
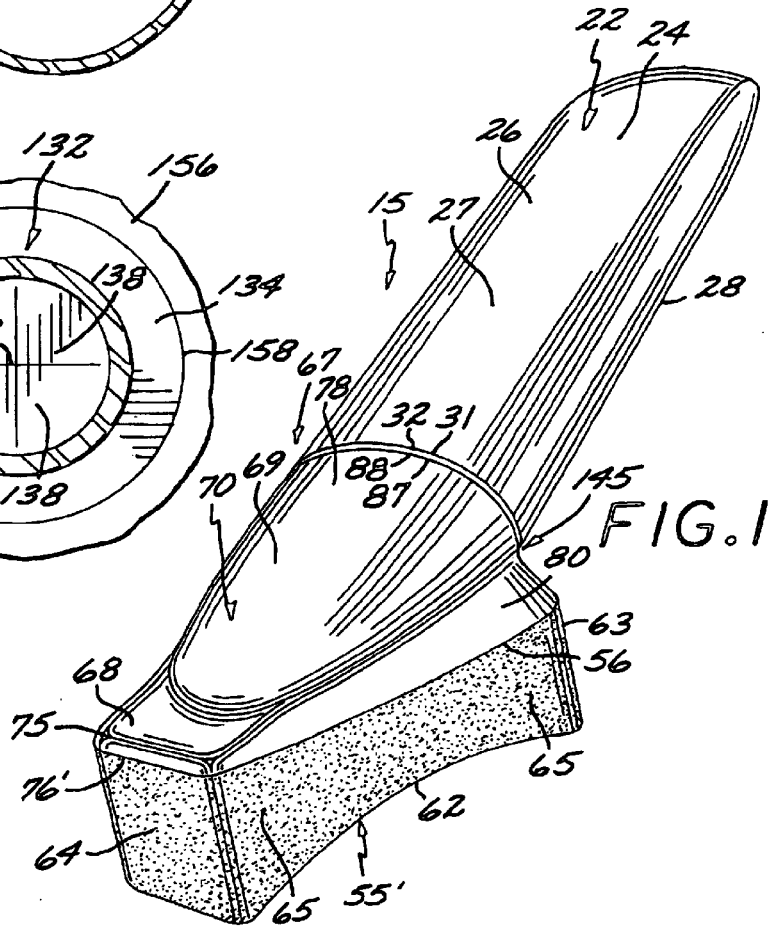
FIG. 12

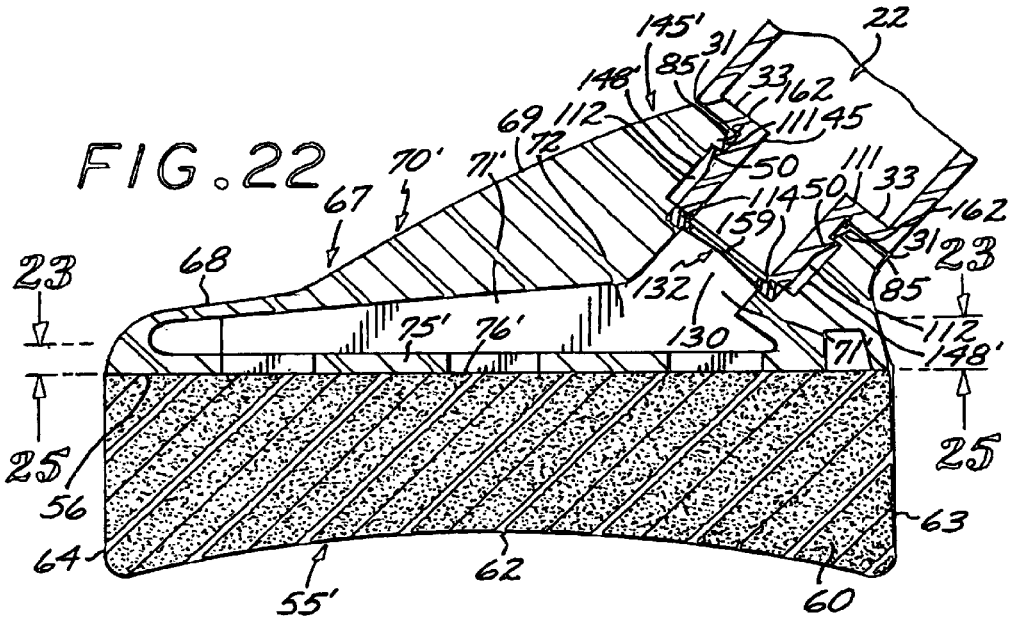
FIG. 22
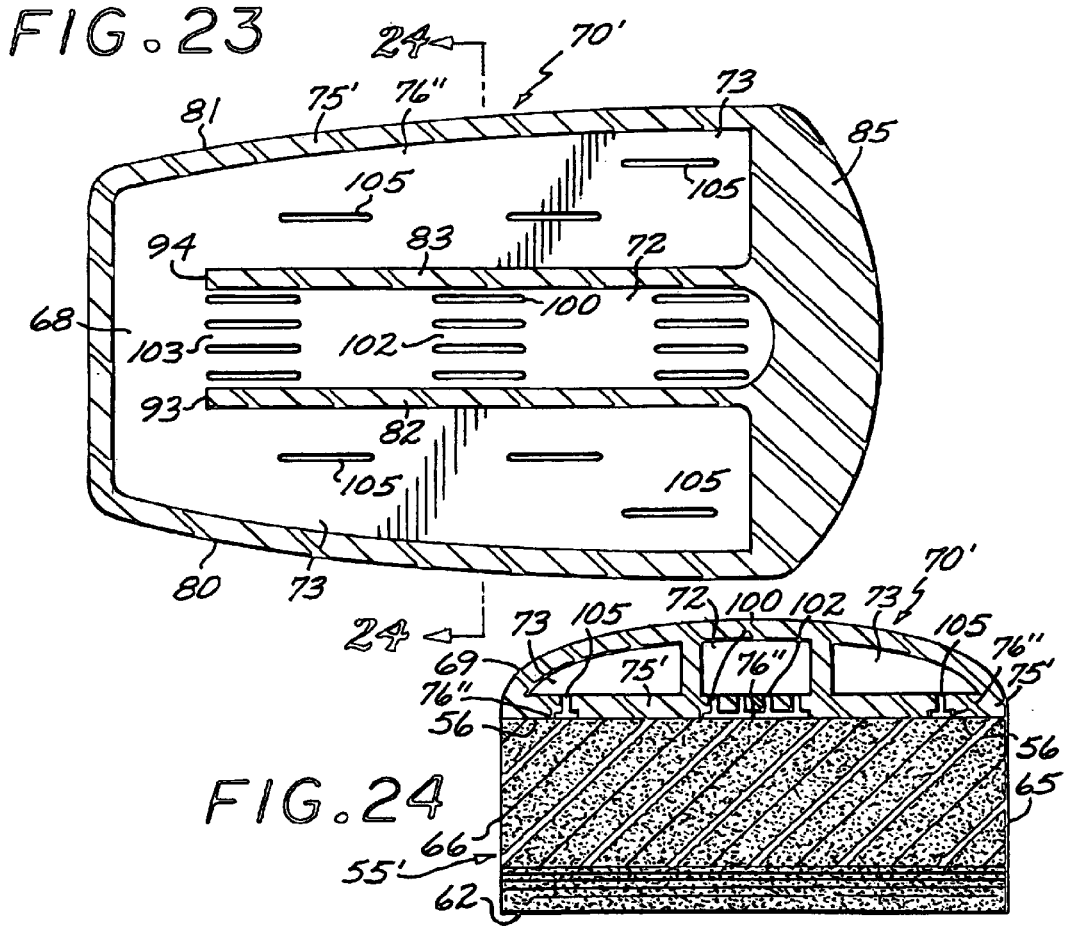
FIG. 23
FIG. 24

COMBINATION TIRE SIDEWALL PROTECTANT DISPENSER AND APPLICATOR

BACKGROUND OF THE INVENTION

1. Field of the Invention

The present invention relates to an applicator device for conveniently and effectively dispensing and applying cleaning fluids or rubber conditioning agents onto a tire of an automobile.

2. Description of Related Art

Automobile owners often use various liquid compounds to protect and maintain the wheels and tires of their vehicles, or to enhance their exterior appearance. Cleaning compounds and fluids, such as those that may be sprayed onto the tire from a standard spray bottle, have been applied to remove dirt and oxidation from the rubber and condition the tire to increase its luster and aesthetic appeal. Upon application to the sidewall of a tire, such fluids will generally form in small fluid beads on the tire surface, whereupon a user will then spread the fluid across a desired treatment area by a rag, sponge or other similar device. Often times, a user may also apply the treatment fluid directly to the application surfaces of such devices for spreading and applying the fluid to a tire wall as desired. However, these devices will generally quickly become soaked with fluid, and must be discarded, cleaned or laundered after use. Laundering sullied rags is time consuming and expensive, and purchasing new devices for each application can also be expensive and inconvenient.

Such devices are also not easily manipulated, and may cause the fluid contained on their surfaces to come in contact with the hands of a user because they lack a handle separating the applicator surface from the user's gripping hand. After each application of fluid by a simple rag or sponge type device, a user may be required to wash his or her hands, which is inconvenient and inefficient. Further, without a readily accessible resupply of treatment fluid, continuous re-application of fluid directly to the tire wall, or to the working surface of the applicator device for spreading on the tire wall, leads to inefficient expenditure of a user's time and energy. Such devices also are not specifically adapted to conform to the convex surfaces of a tire sidewall, and as a result, may lead to uneven application across the tire's exterior surface.

Some prior art devices have been developed to scrub or clean curved surfaces, such as the curved surface of a toilet seat, by providing for an upstanding handle and a base having a concave curved surface and an absorbent fabric attached to its bottom surface. A device of this type is shown in U.S. Pat. No. 5,159,735 to Owens et al. However, such a thin absorbent fabric is not sufficiently resilient to conform to the varying shapes and sizes of conventional automobile tires, and the device is intended to be disposable after a single use. Also, since the base is configured to fit the curvature of a typical toilet seat, it does not have the proper radius of curvature to complementally fit the sidewall of a tire.

Other prior art devices have been proposed for cleaning tires that incorporate a solid, abrasive block which is used to scrub the rubber of a tire, and is constructed by mixing abrasive particles of stone into a binder which is then molded to form a hard abrasive block. A device of this type is disclosed in U.S. Pat. No. 4,779,386 to Harris. While such a device may be effective for abrasive scrubbing, it is not suitable for spreading a fluid on a tire. The block is not shaped to complementally fit the sidewall of a tire and is not pliable enough to conform to the various curvatures of tire sidewalls. In addition, the hard abrasive surface of this device is not suitable to absorb and evenly distribute a fluid.

Further, while many devices have been developed for spreading a liquid onto surfaces in general, these devices do not address the specific need of spreading cleaners and rubber conditioning agents onto the curved surface of a tire without causing them to come in contact with the gripping hand of a user. Such devices may also not be sufficiently pliable to evenly spread a liquid over rough surfaces, such as embossed lettering or the side tread of a tire. To address these needs, U.S. Pat. Nos. 5,987,694 and 5,896,616, which are assigned to the assignee of the present application, issued to Charles F. Large, a named co-inventor on the present application, proposed a tire protectant applicator configured with a concave curved applicator surface to complementally fit and spread liquid to the sidewall of a tire, which also includes a handle for gripping and a cap for storing the applicator when not in use. While commercially successful, these and other prior art spreader devices require the application of treatment fluid directly to the treatment surface or the applicator's working surface, and do not possess an associated container with a ready supply of treatment fluid or other structural features that distribute and dispense fluid from such a container across the applicator's working surface.

Several prior art devices have proposed the basic concepts of a porous applicator fixably mounted to some type of a container having a reservoir or breakable bladder to hold the fluid to be applied therein. The fluid contained within the container of these devices is absorbed into the porous applicator, and the applicator is then applied to a solid surface to distribute the fluid thereon. Because such devices often lack the requisite capabilities for dispensing controlled amounts of fluid over an extended surface area of the applicator pad, they often simply serve to distribute fluid to a central location on the pad, which may result in a concentration of fluid in its center and an insufficient amount at the forward, rear and lateral extremities thereof. Because the contact or treatment surfaces of the applicator pads of such devices are often not adapted to conform to the convex curvature of tire sidewalls, their use in conjunction with a tire will result in a concentration of fluid dispensed to the central portion of the curved surface without a sufficient application to the remaining portions. In addition, the relatively small surface area of some such applicators may make application to an automobile time consuming and laborious.

Other devices have been developed which employ a pliable porous applicator and a handle which acts as a reservoir to hold a liquid therein. The liquid contained within the handle of these devices is absorbed into the porous applicator, and the applicator is applied to a surface to be treated, thereby depositing the liquid thereon. While these devices are effective for a variety of applications such as applying shoe polish to the surface of a shoe, they are not effective for the specific use of evenly spreading liquid onto the sidewall of a tire. The surfaces of these devices do not conform to the convex sidewall of a conventional automobile tire, and are therefore not effective in applying uniform pressure to uniformly distribute a film on the sidewall of such a tire. In addition, the relatively small surface area of these applicators make application to a tire time consuming and laborious.

In recognition of some of the aforementioned shortcomings, a wax applicator has been proposed which includes a flat applicator plate having a central opening therein and a porous pad mounted thereunder and formed with a centrally disposed communication opening. A cylindrical handle forms a liquid wax receiving container and is formed on one end with a coupling plate. The coupling plate is formed with a central opening alignable with the openings in the applicator plate and pad. A domed valve is mounted over such outlet opening to, upon compression of the walls of the handle, release charges of liquid wax to be dispensed directly to the opening in the pad to the underlying surface to be waxed. A device of this type is marketed under the trademark Quick n' Neat™ by Clean Shot Products Co., Emporia, Kans. Such devices fail to provide for distribution of the dispensed liquid throughout the surface of the applicator pad thus inhibiting efforts to provide for broad, uniform application of treatment fluid, and require a certain degree of dexterity and effort to reach and properly apply treatment fluid to the less accessible interior areas of a typical automobile.

Therefore, an applicator device is needed that can provide for a steady, prolonged and efficient flow of cleaning fluid or conditioner across an extended dimension of the applicator pad, which is also adaptable to assume a curvature that will conform to the convex curving surfaces of a typical tire sidewall while also being sufficiently pliable to conform the varying sizes and shapes of a wide array of vehicle tires. It would also be especially beneficial if the housing that mounts the applicator's pad was designed for rapid and secure mating with a complementally designed replaceable fluid container, which may also serve as a handle. The present invention fulfils this need.

SUMMARY OF THE INVENTION

Briefly and in general terms, the present invention is directed to an applicator device for spreading and applying cleaning, rubber conditioning or other treatment fluids to the convex curved surfaces of a vehicle tire. The applicator device includes a flexible wall fluid package, preferably in the form of a container, enclosing a reservoir having a ready supply of treatment fluid that may also serve as a handle by which the user grasps the applicator device.

Joined to the container is a complementally mating applicator head comprising an applicator pad and a dispenser housing including a flow chamber and a bottom distribution plate, to which the applicator pad is affixed or otherwise attached. In one preferred embodiment, the fluid is transferred through the housing to an attachment surface of the applicator pad, and the distribution plate includes a distribution surface having at least one distribution channel, which facilitates the flow of fluid to various desired portions of the applicator pad and may also or alternatively be correspondingly formed on the applicator pad's attachment surface. Such distribution may also be achieved by passages or channels formed in a plate or the like sandwiched into the interface between the distribution plate and the pad. In another permutation, the flow chamber works in conjunction with a plurality of dispensing openings arrayed about the distribution plate to dispense the fluid of the container to the applicator's pad for further transfer therethrough to a working surface. In yet another permutation, the housing may include a central manifold from which distribution channels extend outwardly and forwardly to distribute the fluid across the width and length of the applicator's pad.

For joining the container to the applicator head, various configurations are contemplated, and in one preferred embodiment, the dispenser housing includes a somewhat funnel shaped, upwardly and rearwardly opening skewed cowling disposed about an inlet device, which includes and coupling shell for releasably receiving the neck of the container by way of a snap lock, bayonet fit, threaded engagement or other appropriate connection. The housing is configured with its cowling and inlet device angling upwardly and rearwardly at a predetermined angle to the distribution plate such that the elongated body of the container projects longitudinally of the inlet device at the same predetermined angle when the container is coupled to the housing. When so configured, the container, inlet device and flow chamber cooperate to form a fluid communication path therethrough to the applicator pad. A flow control, which in one preferred embodiment is in the form of a one way valve, is positioned at some point along this communication path to regulate the flow of fluid from the container to the applicator pad.

The applicator pad is dimensioned, contoured and composed of a suitable material to facilitate conforming to a generally concave curvature when it is pressed against the convex curving sidewalls of a variety of vehicle tires. When viewed in plan view, the applicator pad has a similar shape to that of the housing's distribution plate and distribution surface. In one preferred embodiment, the applicator pad is affixed to the bottom distribution plate at a downwardly facing, concave distribution surface configured to complement the shape of a tire. The pad may be of a generally planar construction, but flexed to curve upon mounting to the concave distribution surface, or may be formed to accommodate the curvature of the distribution plate and/or surface. In another embodiment, the distribution plate may be generally planar and the applicator pad formed with a concave applicator working surface configured to complementally receive the convex sidewalls of a variety of vehicle tires. It is also contemplated that the applicator pad may be generally planar but constructed to flex and assume a concave and conforming curvature when pressed against the convex curvature of the same variety of tire sidewalls.

In one preferred embodiment, the fluid package may take the form of a container that is disposable and replaceable, being produced in multiple variants adapted to contain any number of specific use tire treatment fluids. However, it is also contemplated that the container may be refillable by a filling stem projecting outwardly from its proximal end.

In still another preferred embodiment seeking to emphasize a comfortable interaction with the hand of the user, the container may be formed with at least an ergonomically adapted dorsal wall defining a palm pad and designed to be complementally received in the user's palm, and may include finger grooves for receipt of the fingers of the user's grasping hand. Also in keeping with the invention, the container may take the form of a squeeze tube or other appropriate structure formed with flexible walls, whereby squeezing of the walls urges the flow of fluid under pressure along the fluid communication path, through the flow control, and to the applicator pad. In another possible aspect of the invention, the container may be formed with rigid walls requiring the user to elevate the container above the level of the dispenser housing to initiate fluid flow through the housing.

These and other features and advantages of the applicator device will become apparent from the following detailed description of preferred embodiments which, taken in conjunction with the accompanying drawings, illustrate by way of example the principles of the invention.

BRIEF DESCRIPTION OF THE DRAWINGS

FIG. 4 is a bottom view of the applicator device shown in FIG. 1;

FIG. 5 is a left hand end view of the applicator device shown in FIG. 1;

FIG. 6 is a right hand end view of the applicator device shown in FIG. 1;

FIG. 9 is a horizontal sectional view taken along line 9—9 of FIG. 7;

FIG. 10 is a horizontal sectional view taken along line 10—10 of FIG. 7;

FIG. 11 is a partial horizontal sectional view, in an enlarged scale, of the flow control mechanism taken along line 11—11 of FIG. 7;

FIG. 12 is a perspective broken view of a second embodiment of the applicator device of the present invention;

FIG. 22 is a longitudinal sectional view of a third embodiment of the applicator device of the present invention;

FIG. 23 is a horizontal sectional view of the applicator device shown in FIG. 22 taken along line 23—23 of FIG. 22;

FIG. 24 is a transverse sectional view taken along line 24—24 of FIG. 23;

DETAILED DESCRIPTION OF THE PREFERRED EMBODIMENTS

Figure 13:
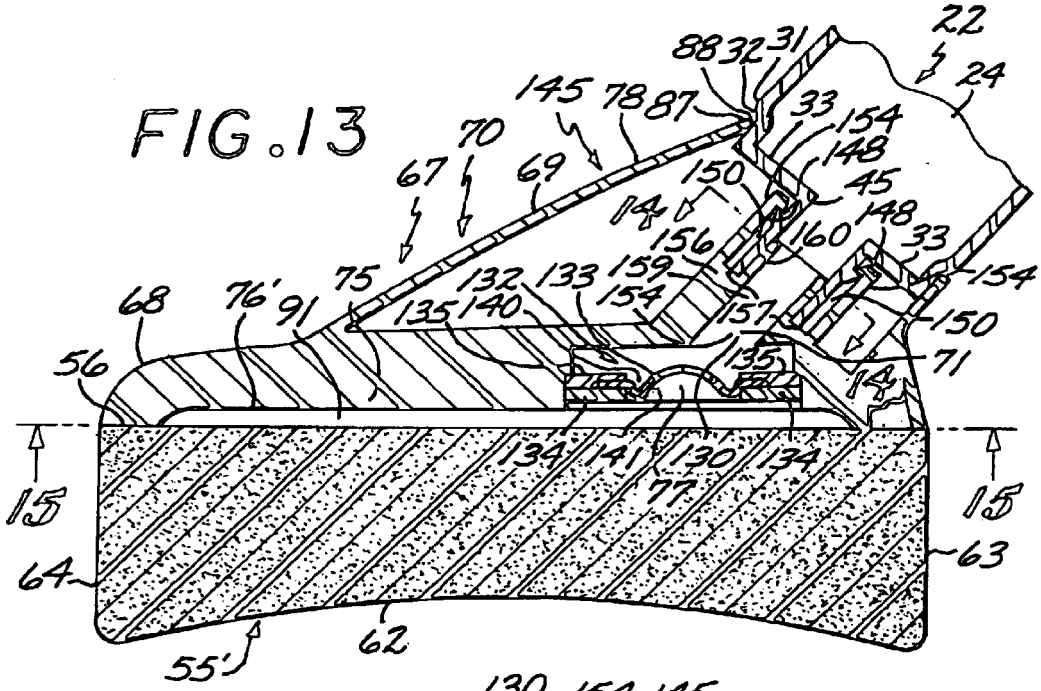
FIG. 13 is a longitudinal sectional view, in enlarged scale, of the applicator device shown in FIG. 12.
Figure 14:
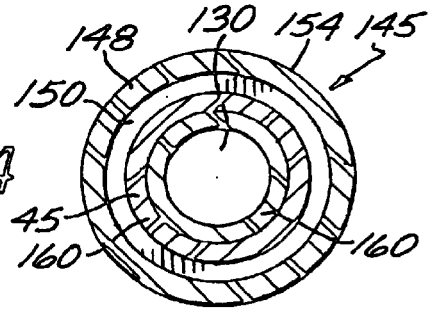
FIG. 14 is a transverse sectional view, in enlarged scale, taken along line 14—14 of FIG. 13.
Figure 20:
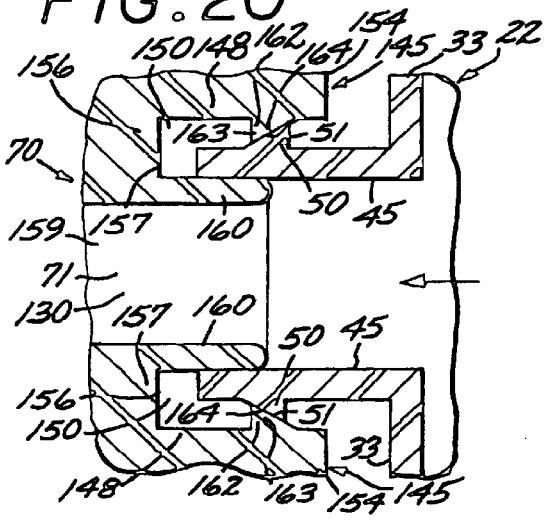
FIG. 20 is a longitudinal sectional view, in an enlarged scale, of a container coupling assembly included in the device shown in FIG. 13.
Figure 21:
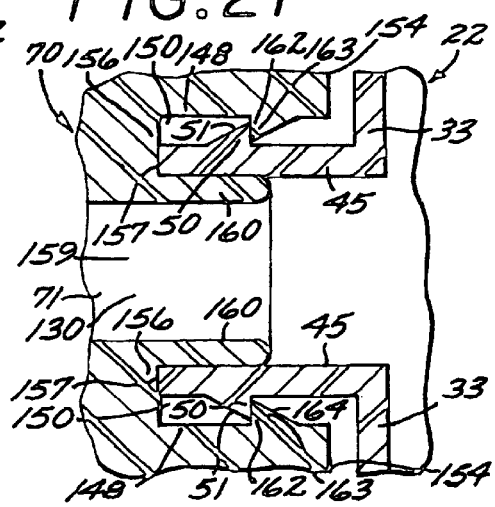
FIG. 21 is a longitudinal sectional view similar to FIG. 20.

Referring to FIGS. 1–3 and 12, the tire applicator device 15 of the present invention includes, generally, an applicator head 67, a dispenser housing 70, an applicator pad 55 and a fluid package, which in a preferred is in the form of a container 22 that both defines a container reservoir 24 for storing fluid and serves as an elongated handle. The applicator head 67 includes a housing 70 formed with a bottom distribution plate 75, which includes a distribution surface 76. With reference now to the preferred embodiment of FIG. 7, the housing 70 further includes a flow chamber 71 and a container coupling assembly 145 including an inlet device 148 projecting rearwardly from the flow chamber 71 for coupling with the container 22 to secure it to the housing 70. The inlet device 148 may take on any convenient shape or form for transferring fluid therethrough to the flow chamber 71, and includes a coupling shell 154 and a coupling wall 156. Further, in another preferred embodiment, as depicted in FIGS. 13 and 20–21, the inlet device 148 may include a tubular inlet boss 160. With continued reference to the preferred embodiment of FIG. 7, a flow control device, generally designated 132, for metering the flow of fluid to the applicator pad 55 is interposed at some point along a fluid communication path 130 that extends from the container 22 through the inlet device 148 and the flow chamber 71, to deliver fluid to the distribution plate 75 for distribution therethrough the distribution surface 76 and then to the applicator pad 55. The pad is mounted to the distribution surface 76 at a pad attachment surface 56 by any appropriate affixation or bonding means as is well known in the art. As set forth in detail below, the pad 55 affixed thereto is further formed with a working surface 62 that is dimensioned, contoured and sufficiently pliable to assume a complemental curvature that will conform to the convex curving surface found in the typical sidewall of a variety of vehicle tires.

Figure 2:
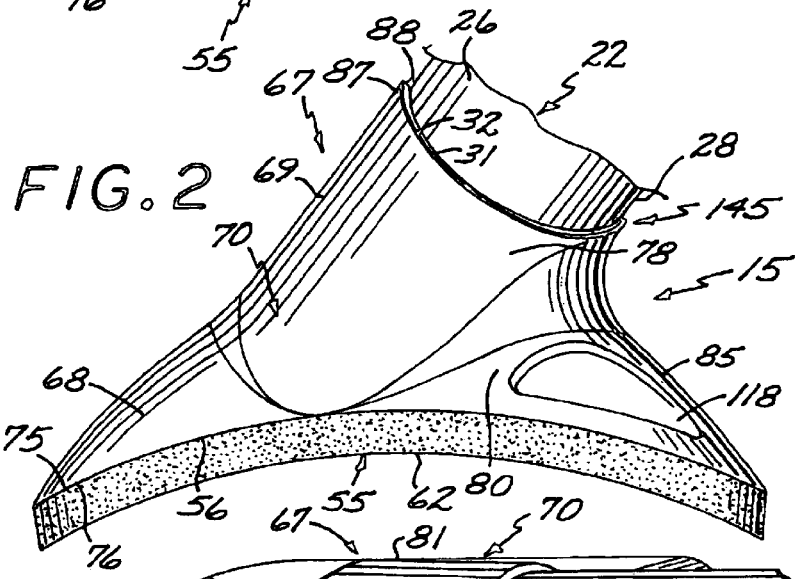
FIG. 2 is a front view of the applicator device shown in FIG. 1.
Figure 7:
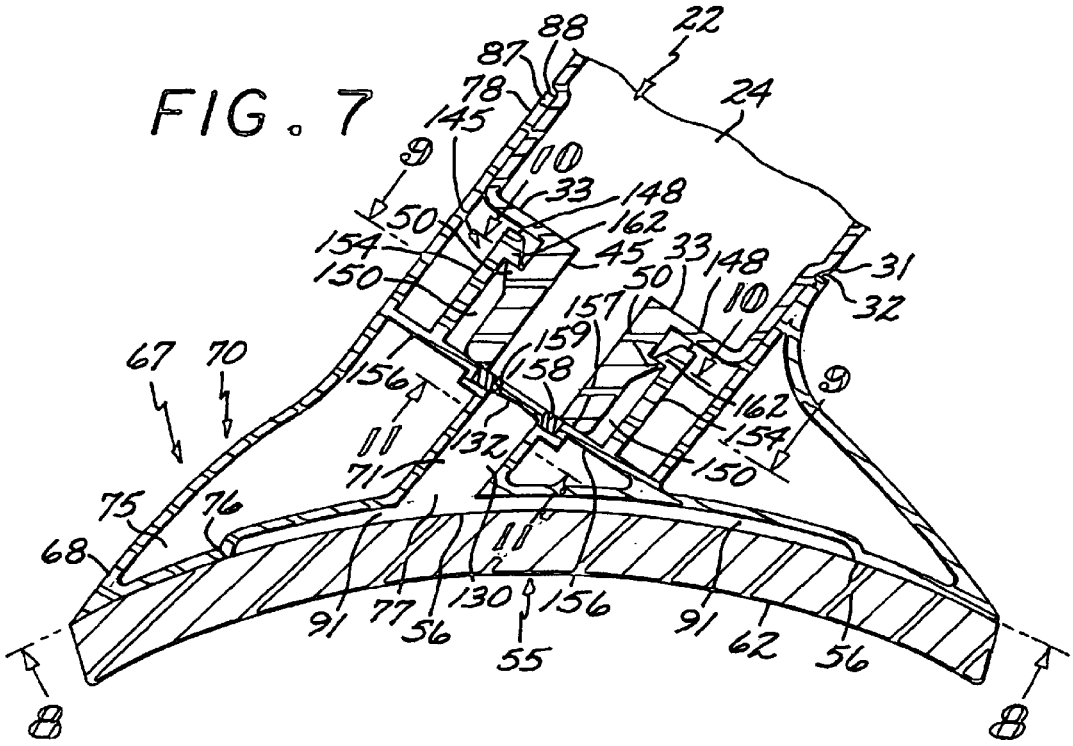
FIG. 7 is a longitudinal sectional view, in enlarged scale, of the applicator device shown in FIG. 1.

In a preferred embodiment, as shown in FIGS. 2 and 7, the distribution plate 75 may be configured with a downwardly opening, concave distribution surface 76 to which the attachment surface 56 of the applicator pad 55 is affixed, with the distribution surface 76 being specifically designed to complementally receive the outwardly curving, convex outer surfaces of a wide variety of vehicle tires. However, in another preferred embodiment, as shown in FIGS. 12–13, it is also contemplated that the distribution surface 76' may be generally planar, and that the applicator pad 55' affixed thereto may, for instance, include a working surface 62 that is concave for complementally mating with the outwardly curving, convex outer surfaces of the same wide variety of typical vehicle tires.

Figure 8:
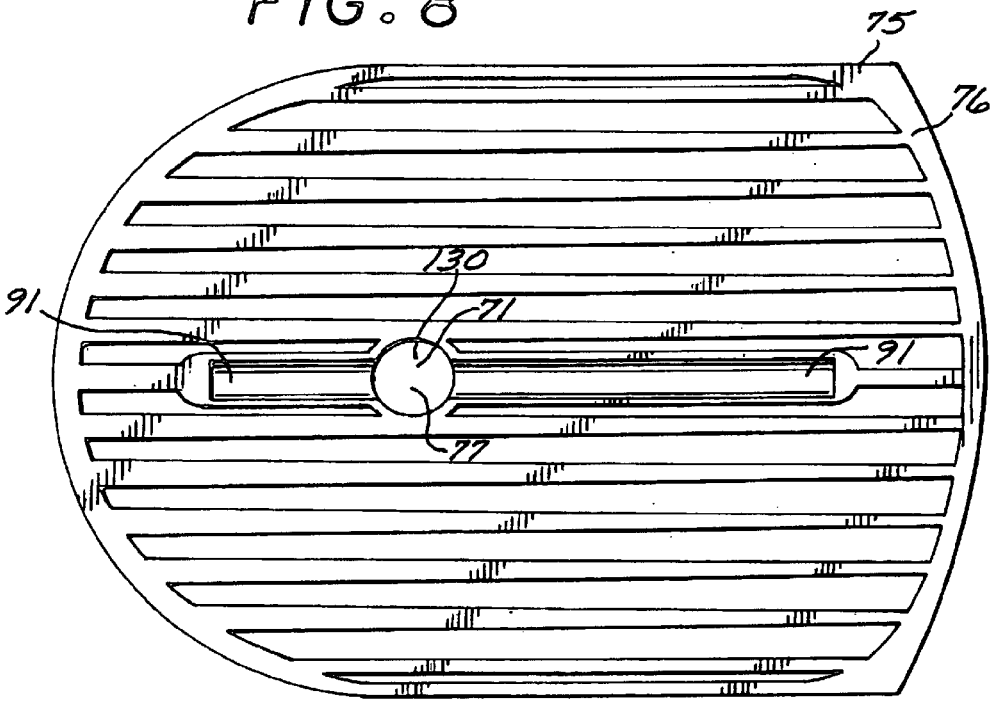
FIG. 8 is a horizontal sectional view taken along line 8—8 of FIG. 7.
Figure 26:
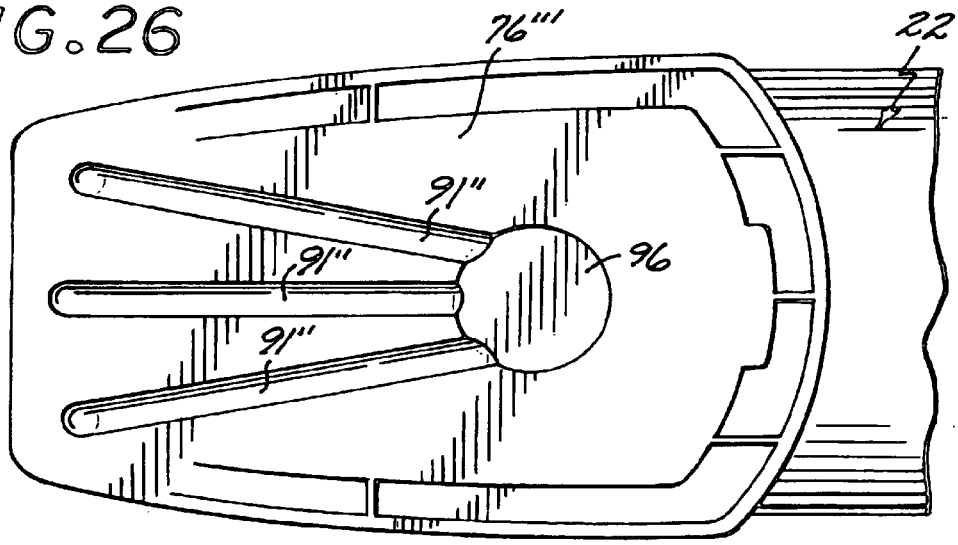
FIG. 26 is a horizontal sectional view of the applicator head of a fourth embodiment of the applicator device of the present invention.

In all embodiments, distribution plate 75 is formed with a flow distribution capability, which, as shown in FIGS. 7–8, may include at least one distribution opening 77 and at least one longitudinal distribution channel 91. As also shown in the embodiment depicted in FIG. 15, this distribution capability may also include a plurality of distribution branches 92 extending laterally outwardly from the distribution channel or channels 91'. It is contemplated, however, that the distribution capability may take on any number of forms, such as, for example, the distribution plate 75 being formed with a plurality of openings to pass the fluid therethrough, slits formed through the plate or in its bottom surface or a sieve type arrangement in the plate. While the preferred embodiment of FIG. 8 depicts one such distribution channel 91 extending longitudinally along the distribution surface 76, it is also contemplated that the distribution plate 75 or distribution surface 76 may be formed with a plurality of such channels 91 extending across its longitudinal and lateral dimensions, or, as shown in the embodiment of FIG. 26, that a distribution surface 76''' may be formed with a plurality of channels 91'' extending outwardly from a central distribution manifold 96.

Figure 27:
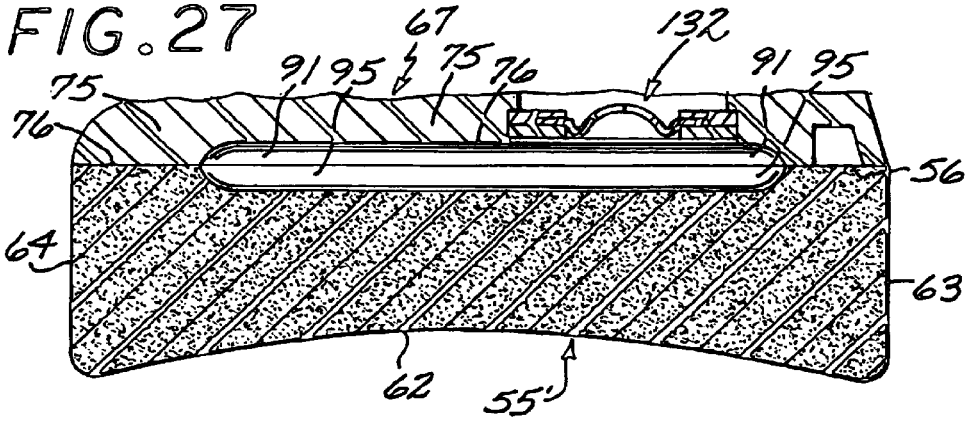
FIG. 27 is a longitudinal sectional view of a modification of the applicator device as shown in FIG. 13.
Figure 28:
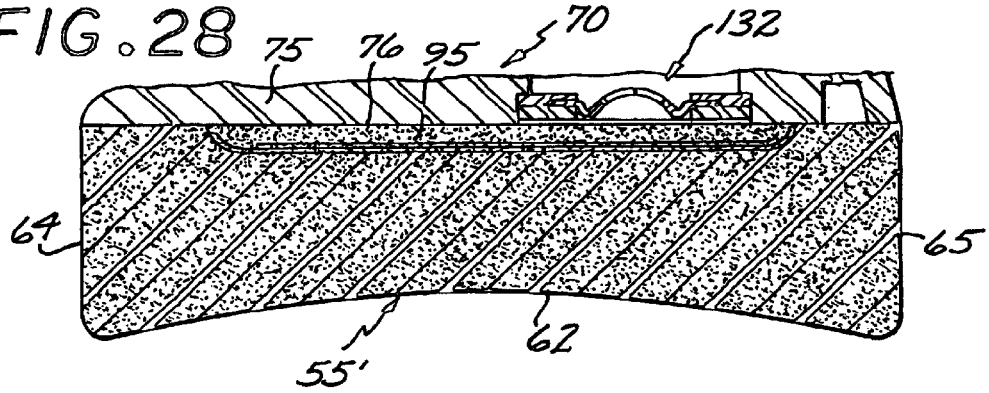
FIG. 28 is a longitudinal sectional view of a modification of the applicator device as shown in FIG. 13.

As shown in FIG. 27, it is also contemplated that, in all embodiments, the attachment surface 56, on the top side of the applicator pad 55, may also be formed with at least one distribution channel 95 to further facilitate the fluid flow across the attachment surface 56. As shown in FIGS. 27–28, the attachment surface 56 may be formed with such channels 95 to independently (FIG. 28) or, in combination with the channels 91 (FIG. 27), serve as the distribution means. While the distribution channels 91 and 95 are preferably formed in the distribution plate 75 and surface 76 or confronting side of the pad, as will be apparent to those skilled in the art, such distribution may also be achieved by passages or channels formed in a plate or the like sandwiched into the interface between such plate 75 and pad 55.

Figure 15:
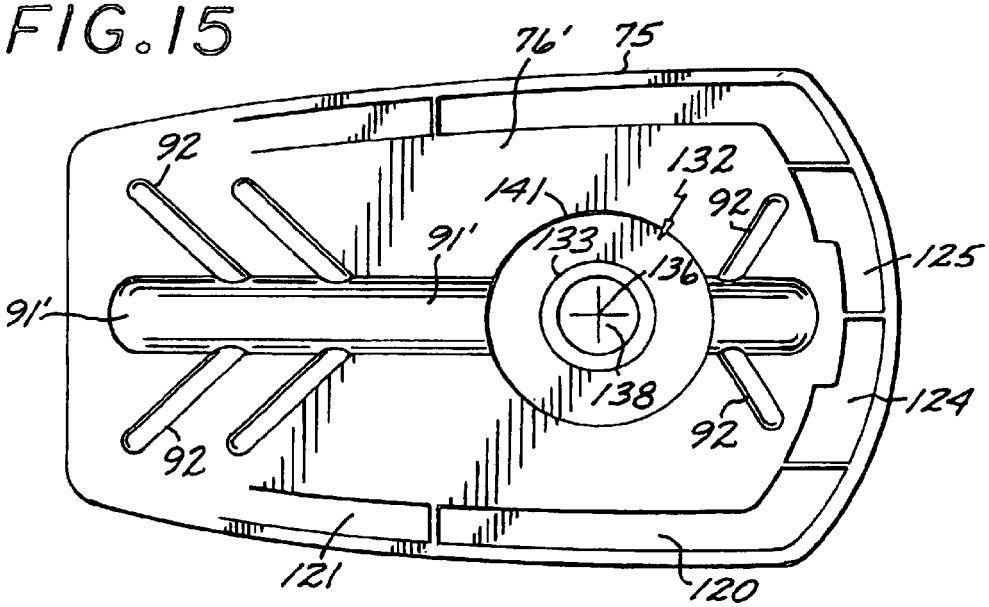
FIG. 15 is a horizontal sectional view taken along line 15—15 of FIG. 13.
Figure 16:
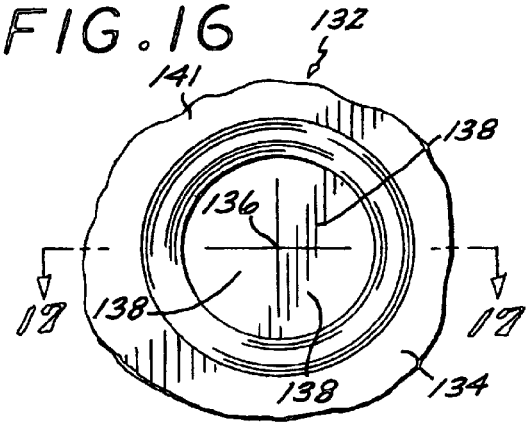
FIG. 16 is a partial horizontal sectional view, in an enlarged scale, of the flow control mechanism shown in FIG. 13.
Figure 17:
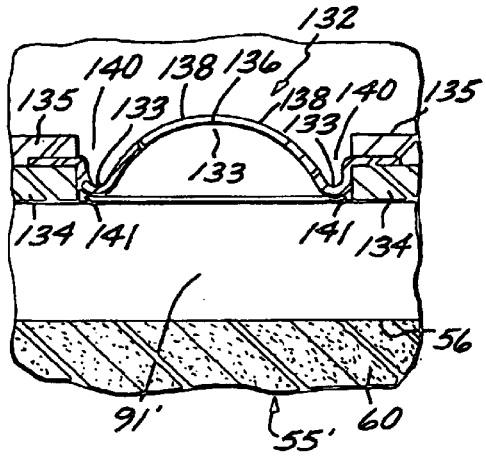
FIG. 17 is a vertical sectional view taken along line 17—17 of FIG. 16.

The exemplary applicator pad 55 is of a semi-open cell foam construction and serves to receive fluid from its top side attachment surface 56 after it passes from the container 22 through the flow chamber 71, flow control 132, distribution plate 75 and distribution opening 77 (see e.g. FIGS. 7 and 13). The density of the semi-open cell pad 55 and the viscosity of the fluid is such as to restrict the rate at which the viscous fluid is dispensed therethough. In practice, as is evident by reference to the exemplary embodiment of FIG. 7, after the fluid is deposited on the applicator pad 55, a portion will flow through the local area of the pad. The remainder of the deposited fluid will pool on the attachment surface 56 and then travel along the distribution channel 91 to be distributed longitudinally along the center of the pad 55, and laterally through the distribution branches 92 as shown in FIG. 15, or other such distribution channels, for flowing downward through the pad 55 to the working surface 62, which defines the underside of the pad 55. In one preferred embodiment, as shown in FIGS. 7–8, the downwardly curving shape of the distribution surface 76, and the distribution channel 91 formed therein, permits gravity to assist in distributing the fluid from the local area of the applicator pad throughout its longitudinal and lateral dimensions when the applicator device is positioned in an upright manner.

Figure 29:
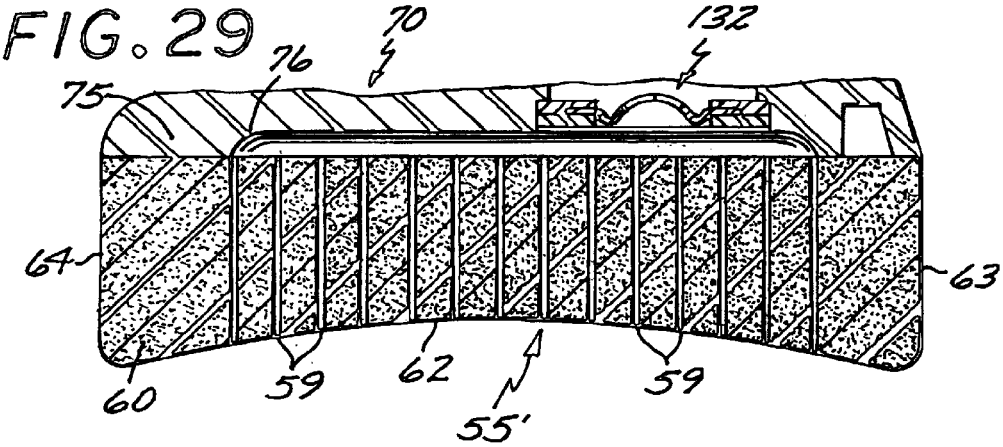
FIG. 29 is a longitudinal sectional view of a modification of the applicator device as shown in FIG. 13.

With reference to the exemplary depiction shown in FIG. 29, in all embodiments it is contemplated that, in order to facilitate the transfer of fluid through the applicator pad 55' to specific strategic locations on the working surface 62, the pad 55' may be formed with through channels 59 arrayed thereabout and extending from the attachment surface 56 to the working surface 62. Such channels 59 facilitate an even distribution to the working surface 62 of the fluid traveling through the distribution channels 91, 92 and/or 95. It is also contemplated that pin holes (not shown) punched in the attachment surface 56 may be situated thereon to promote absorption and flow through the pad 55' at specific desired locations, or that the area of the pad not incorporating a distribution channel may also incorporate through channels 59 for passing fluid from the attachment surface 56 to the working surface 62. Additionally, it is also contemplated that, in order to promote a more rapid transfer of fluid through the pad 55 to desired portions of the working surface 62, such as, for example, on the lateral extremities of the pad, these desired portions may be formed with pre-cut indentations defining a stepped down transverse cross-sectional depth or may be formed from a more porous material than is found in the remainder of the pad 55.

The applicator pad 55 may take any convenient shape, and its attachment surface 56 will generally conform in shape and contour to the distribution surface 76 of the bottom distribution plate 75. For example, as shown in the embodiments depicted in FIGS. 13 and 22, when the distribution surface 76' and 76'' is generally planar, the attachment surface 56 of the pad 55' will also be generally planar. However, in the preferred embodiment incorporating a concave curving distribution surface 76, as shown in FIG. 7, the attachment surface 56 of the pad 55 may be generally planar but will conform to the contour of the distribution surface 76 when affixed thereto. In such an embodiment, it is also contemplated that the pad 55 may also be specifically contoured with a convex curving attachment surface 56 to complementally mate with the concave curving distribution surface 76.

The applicator pad 55 is preferably formed with the working surface 62 being curved in a concave manner to define a saddle shape adapted for engagement with the convex curving surfaces of a typical tire sidewall. This working surface curvature permits a user to evenly spread the desired fluid onto the tire by applying a substantially even pressure across the length of the curved surface. However, it is also contemplated that the pad 55 may be generally planar. For example, in a preferred embodiment incorporating a concave curving distribution surface 76, as depicted in FIG. 7, the pad 55 may also be planar and flexile to conform to the convex curvature of the tire sidewall. In another embodiment, the pad may be formed such that, in its relaxed condition, the working surface 62 is planar, but with sufficient compressibility such working surface may be compressed centrally to thereby conform to the convex shape of the tire sidewall. In such an embodiment, the same even spreading of the fluid is realized when the user engages the applicator head 67 with force directed against the tire's sidewall, which in turn causes the working surface 62 to compress inwardly and assume a generally concave curvature that is complemental to the convex curvature of the tire sidewall.

In a preferred embodiment, the concave working surface 62 (see e.g. FIG. 13) and/or concave curving distribution surface 76 (FIG. 7) has a radius of curvature of approximately 4 inches, however, depending on the desired application, it is also contemplated that a suitable radius of curvature may fall anywhere within the range of 3 to 4.5 inches. This is due to the fact that tires are manufactured in various shapes and sizes, and a curvature radius in this range is suitable for complementally fitting most vehicle tires. Also, the applicator pad 55 is sufficiently pliable to accommodate tires having a somewhat higher or lower profile and correspondingly larger or smaller radii of sidewall curvature. Additionally, while the circumference of a given tire will include varying curvatures, being squatter and more curved at its bottom than at its top, the flexibility of the pad 55 or 55' permits the working surface 62 to effectively engage these varying curvatures on a given tire sidewall.

Figure 1:
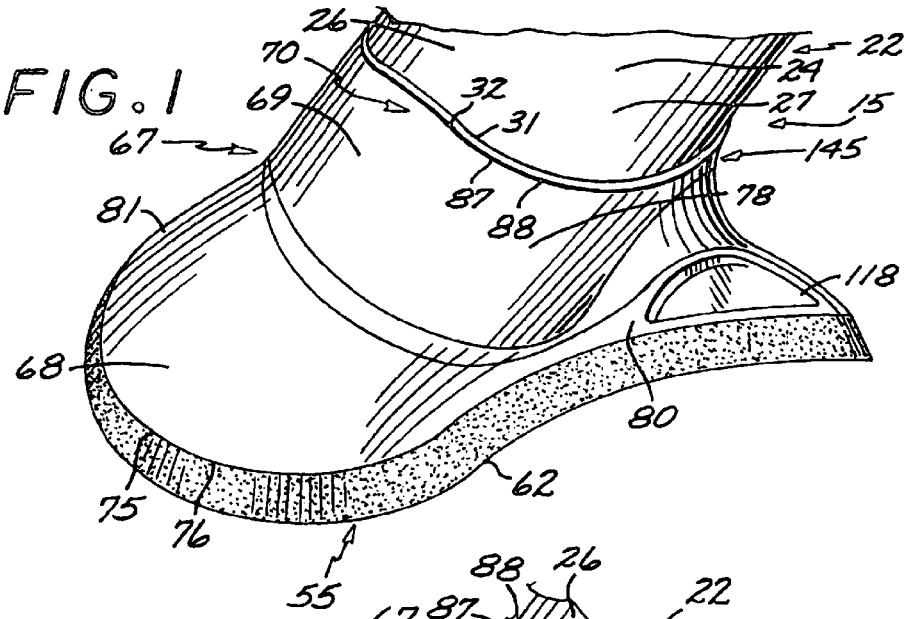
FIG. 1 is a partial perspective broken view of an applicator device embodying the present invention.

As shown in FIGS. 1 and 2, the applicator pad 55 is configured with the attachment surface 56 to be attached to the distribution surface 76 of the distribution plate 75 at an interface therebetween by one of the many suitable bonding agents or other affixation means known in the art. To this end, the distribution surface 76 may be formed with a smooth and solid surface, or, in a preferred embodiment, may be formed with any appropriate surface pattern, such as a grid or parallel ridges as shown in FIG. 8, to provide surface area for bonding the attachment surface 56 of the pad thereto. As shown in the alternate embodiment of FIG. 15, the distribution surface 76' may also be conveniently formed along its lateral opposite edges with downwardly opening shallow, blind cavities 120 and 121, which act as lightening holes. The rear edge of the distribution surface 76' may too be formed with a row of laterally projecting downwardly opening lightening cavities 124 and 125. The contours of these cavities, which can also take on any convenient shape, dimension and location, cooperate in defining the distribution surface 76' to which the pad 55' is mounted.

The pad 55 or 55' is preferably constructed in the form of a semi-open cell polymer sponge like material, which can be either formed by injection molding or cut from a stock of foam such as is well known to be suitable in the art. However, while the viscosity of the fluid will influence its rate of flow through the pad, it is contemplated that the pad may be formed of any material conducive to providing a desired level of resistance to prevent rapid fluid transfer therethrough to the working surface 62. For example, it is contemplated that the applicator pad 55 or 55' may be formed with semi-open, open or closed cell foam, or with fibers having similar characteristics, or with bristles, such as those found in a brush, or with a porous flow control screen or wall or any other suitable material or structure for passing fluid therethrough to the working surface 62.

It is further contemplated that the attachment surface 56 of the pad 55 or 55' may correspond generally in shape and surface area to that of the distribution plate 75. The material composition, shape and dimensions of the applicator pad are not essential to the present invention, with the fundamental importance of the pad being that it is adaptable to assume a complemental curvature that will conform to the convex curvature of a typical vehicle tire sidewall when the pad is applied thereto. Therefore, the material composition, shape and dimensions of the applicator pad 55 or 55' may be varied to suit a desired application or to work most effectively with the formulation and viscosity of a chosen treatment fluid. In the embodiments incorporating a concave curving distribution surface 76, as shown in FIG. 7, a large magnitude of depth in the pad 55 is not required and its depth may be uniform across its length. This is due to the fact that the distribution surface 76 itself is designed to conform with the curvature of the tire's sidewall. Therefore, in such embodiments, the depth of the pad 55 will be relatively lessened in comparison to those embodiments incorporating a generally planar distribution surface, and may, for example, be as thin as ¼ of an inch.

As shown in another preferred embodiment incorporating a generally planar distribution surface 76', such as shown in FIG. 13, it is contemplated that the pad 55' will incorporate a relatively greater depth. For example, as shown in FIG. 12–13, the outer perimeter of the pad may extend downwardly in a transverse orientation to the longitudinal axis of the distribution plate 75 to define the saddle shaped, concave curving working surface 62. In such an embodiment, the pad 55' may appear somewhat trapezoidal in plan view, and may include a proximal wall 63, a laterally stepped down distal wall 64, and a pair of laterally spaced apart, gradually inwardly and forwardly curving side walls, 65 and 66. In one possible configuration as shown in FIG. 12, the pad 55' has a depth of about 1½ inches at its proximal and distal walls, 63 and 64 respectively, and a depth of ¾ inch at its center. However, it is contemplated that the depth of the pad at the distal wall 64 may be slightly less than the depth at the proximal wall 63, for example measuring about 1⅜ inches. Additionally, in keeping with the spirit of the invention, the dimensions, material composition and shape of the applicator pad may be varied depending on such considerations as the viscosity of the chosen treatment fluid, the shape of the distribution surface and the radius of curvature of a tire's sidewall.

Turning now to the construction of the housing 70, it may be formed of any convenient and suitable material, but is preferably formed from polypropylene or of any appropriate molded high density plastic, as are known in the art. The housing 70 may further take any convenient shape or form, having, for example, an oval, semi circular or triangular cross sectional shape. In the present invention, the structure of the housing 70, its inner workings and the manner in which it is releasably connected to the container 22 are generally similar in a first embodiment shown in FIGS. 1–11 ("first embodiment" hereinafter) and a second embodiment shown in FIGS. 12–21 ("second embodiment" hereinafter). Therefore, to highlight the contemplated construction that is within the scope of the invention, where the structure of the embodiments is similar, they will be discussed collectively below, and where they differ, these differences will be highlighted by reference to the various figures.

In the first and second embodiments as shown in FIGS. 2 and 12, the housing 70 is conveniently configured with a shell 69 having outer contours that define a shape generally resembling that of a shoe. The housing is further formed with a nose section 68 and a cowling 78 extending rearwardly and upwardly therefrom, and may include a pair of laterally spaced apart side walls, 80 and 81, extending downwardly from the lateral edges of the cowling 78, and a housing rear wall 85 (FIG. 2 and 6), angling downwardly and rearwardly from the bottom edge of the cowling 78. As shown in FIGS. 1–2 and 6, it is contemplated that the side wall 80 or 81 and housing 70 may be formed with a lightening cavity 118 or a pair of oppositely disposed such cavities.

Tapering rearwardly and upwardly from the forwardly disposed nose section 68 (see FIGS. 2 and 12), while angling rearwardly and laterally outwardly, the housing 70 may be formed rearwardly with the coupling assembly 145, which may include the somewhat oval in transverse cross section cowling 78 disposed about the inlet device 148, as shown in FIGS. 7 and 13. With continued reference to FIGS. 1–3 and 12, while it is contemplated that the user will generally gain favorable purchase of the applicator device 15 by grasping the container 22 as a handle, the side walls, 80 and 81, may provide convenient finger pads that permit the user to grasp the device by the housing 70 and cowling 78 when he or she desires to exert a greater and more focused degree of inwardly directed force to a given tire surface.

Figure 30:
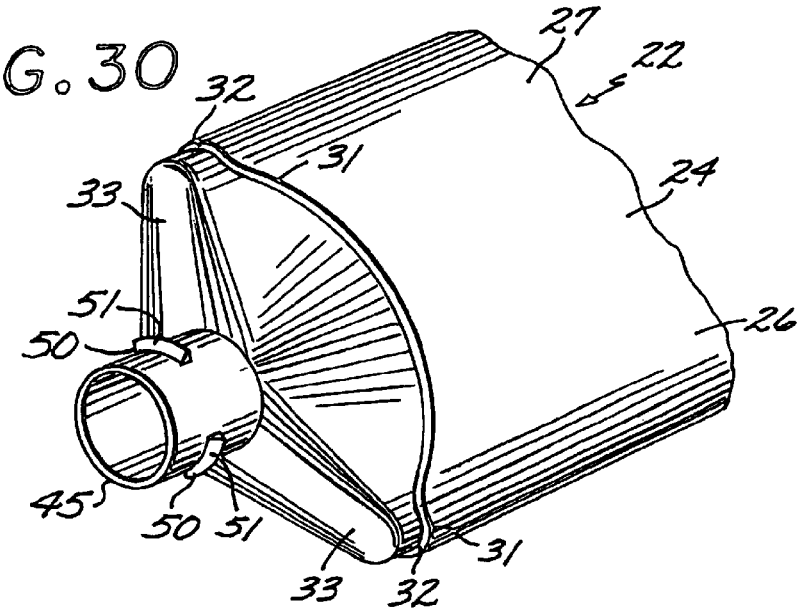
FIG. 30 is a partial perspective view in an enlarged scale, of the container handle shown included in the applicator device as shown in FIG. 12.

With continued focus on the structure of the housing 70, as shown in the first embodiment at FIGS. 1–2 and the second embodiment in FIG. 12, the coupling assembly 145 may include the rearward portion of the dispenser housing 70 and cowling 78, and is adapted to receive the container 22 therein. As shown in FIG. 30, to be received in the coupling assembly 145, the container 22 may include an end wall 31 and a yoke 33 centrally formed with an outwardly extending neck 45. The coupling assembly 145 may be adapted to receive the neck 45 and yoke 33 while mating with complemental surfaces in the end wall 31 of the container. The inlet device 148 of the coupling assembly 145 projects upwardly and rearwardly from the major longitudinal surface of the distribution plate 75. While this angle may be set at any value to optimally promote the flow of fluid from the container 22 through the flow chamber 71 to the applicator pad 55, it will preferably fall in the range of approximately 30° to 40°.

As shown in FIGS. 7 and 13, the inlet device 148 extends upwardly and rearwardly from the flow chamber 71, and includes a coupling shell 154 that is disposed about a rearwardly opening cavity 150 for receipt of the neck 45 that projects forwardly from container 22 (see also FIG. 30). While an annular configuration has been depicted for this cavity in FIGS. 9–10 of the first embodiment and FIG. 14 of the second, it is contemplated that the cavity 150 may be of any convenient and appropriate shape for receipt therein of a corresponding in shape container neck 45. As shown in FIGS. 7 and 13, and in more detail in FIGS. 20–21, in both embodiments, the inlet device 148 is proximally formed with a coupling wall 156 that defines an outwardly facing neck abutment surface 157 such that the distal extent of the container neck 45 is abutted thereagainst when the neck is received in the cavity 150. A central opening 159 formed in the coupling wall 156 permits the flow of fluid therethrough and into the adjacent flow chamber 71.

Figure 18:
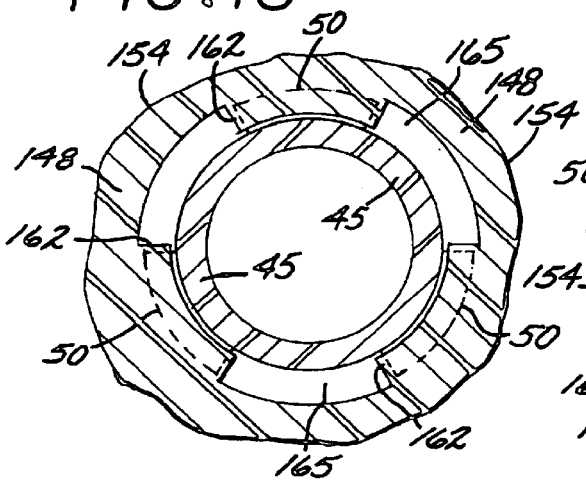
FIG. 18 is a transverse sectional view, in an enlarged scale, of the container coupling mechanism of the device shown in FIG. 13.
Figure 19:
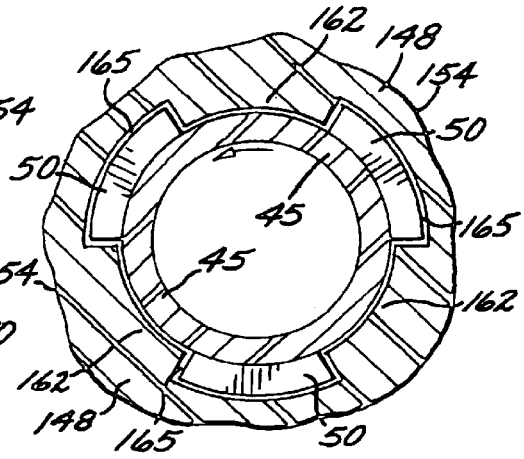
FIG. 19 is a transverse sectional view, in an enlarged scale, of the container coupling mechanism of the device shown in FIG. 13 similar to FIG. 18.

To operate in conjunction with the structure of the neck 45 to releasably connect the housing 70 to the container 22, as shown in FIGS. 7 and 10 of the first embodiment and FIGS. 13 and 18–19 of the second embodiment, the coupling shell 154 is further formed at its distal extremity with a plurality of inwardly projecting lugs 162, which are arrayed thereabout and spaced apart to define respective clearance slots 165 therebetween. For example, in a preferred embodiment depicted in FIGS. 10 and 18–19, three such lugs 162 are spaced annularly equidistantly apart to define three corresponding clearance slots 165 therebetween.

As shown in the second embodiment at FIGS. 13–14 and 20–21, it is also contemplated that the inlet device 148, coupling shell 154, and cavity 150 may be disposed about an inlet boss 160, that projects rearwardly and upwardly from the coupling wall 156. In such an embodiment, when the container neck 45 is received in the cavity 150 and abutted against the neck abutment surface 157, the inlet boss 160 is specifically dimensioned to be received within the neck 45 of the container with the neck disposed thereabouts in a friction fit relationship. So configured, the inlet boss 160 will assist in guiding the fluid flow from the container 22, through the central opening 159 and into the flow chamber 71.

In both the first and second embodiments, with the container 22 releasably received in the housing 70, the neck 45, inlet device 148, flow chamber 71 and distribution plate 75 then cooperate to define fluid communication path 130 therebetween for flow of fluid from the container 22 to the applicator pad 55. Positioned at some point along this fluid communication path 130, a flow control 132 functions to control the flow of fluid therethrough.

As shown in FIGS. 7 and 9–11, in one embodiment, the flow control 132 may be positioned along the fluid communication path 130 adjacent to the distal extent of the container neck 45 when the container 22 is mounted in the housing 70. To accomplish this, as shown in FIG. 7, the coupling wall 156 may be formed with a stepped down cut-out disposed between the neck abutment surface 157 and the central opening 159 that defines a flow control mounting ledge 158, with the flow control 132 being nested therein. While this nesting may be accomplished by a variety of suitable constructions, in an exemplary embodiment as shown on FIG. 17, the flow control 132 includes a pair of mounting rings, 134 and 135, received telescopically in the mounting ledge 158 (see FIG. 7), that mount centrally therein a control valve 133.

While the construction and material composition of the valve 133 may be varied depending on the viscosity of the treatment fluid and the desired flow characteristics for a given application, in a preferred embodiment as shown in FIG. 11, the control valve 133 is a one way flow valve in the form of a flexible polymer sheet configured with a dome having a cruciform slit 136 therein to form diametrical slits oriented at 90° to one another to form triangular leaves 138. Upon application of fluid pressure to the top side thereof, radially inward points of these leaves 138 are flexed downwardly and outwardly to cooperate in forming an opening for downward flow of fluid therethrough along the fluid communication path 130, into the distribution channel 91 and onto the applicator pad attachment surface 56. Upon release of such top side fluid pressure, further flow of fluid through the opening in the valve 133 will be prevented as the leaves 138 return to their original closed configuration.

As shown in FIGS. 13 and 15, in a second embodiment, it is also contemplated that the flow control 132 may be positioned within the distribution plate 75. In such an embodiment, the coupling wall 156 is not formed with a flow control mounting ledge 158. Rather, as shown generally in FIGS. 13 and 15 and in greater detail in FIGS. 16 and 17, the distribution plate 75 may be formed with a through bore 140 for communicating with the under side thereof. Such bore 140 is counterbored from the bottom at counterbore 141 for nesting there up into the flow control device 132. The flow control 132 includes a pair of mounting rings, 134 and 135, received telescopically in the counterbore 141, that mount centrally therein the control valve 133.

While a one way valve embodiment has been described, the flow control 132 may take on a variety of forms known in the art, for example a porous disc, duck bill or flapper valve, membrane, other types of valves or any other suitable means for metering the flow of fluid therethrough to a predetermined rate. Also, in the preferred embodiments discussed, the flow control 132 is described as being located in the coupling wall 156 or the distribution plate 75, however, it may be located at any other point along the fluid communication path 130 extending from the container 22 to the applicator pad 55 so long as it functions to control the flow of fluid therethrough. For example, the flow control 132 may also be disposed within the inlet boss 160 of the second embodiment, or situated in the fluid communication path 130 at any point within the flow chamber 71. It is also contemplated that the flow control 132 may be located at the distal extremity of the bottle neck 45, and take the form of any appropriate squeeze bottle type flow control or opening known in the art. Further, the viscosity of the fluid may further influence the chosen construction of the flow control 132, as it is known in the art, for example, that lower viscosity fluids are more likely to be inhibited from flowing through a one way flow type valve than those fluids having a higher viscosity. Thus, it is contemplated that the specific construction of the flow control 132 may also vary depending on the material composition of the chosen treatment fluid to be dispensed therethrough, as is known in the art.

Focusing now on the container 22, as shown in the exemplary embodiment of FIG. 12, it includes a dorsal wall 26, a ventral wall 28 and a end wall 31. The container 22 may be multi-purpose in that the distended, self supporting flexible walls cooperate to define an elongated, somewhat oval in transverse cross section handle, by which the user may gain favorable purchase of the applicator device 15, while also defining a fluid reservoir 24 containing a supply of cleaning or protecting fluid. In a preferred embodiment as shown in FIG. 30, the container 22 also serves as the treatment fluid's package, and may take the form of a squeeze bottle formed of a durable yet resilient plastic to form walls that, in their unflexed configuration, maintain their shape and outward dimensions, but are also compressible inwardly by squeezing to reduce the interior volume to elevate the interior pressure to drive the fluid out into the distribution network. Being self supporting, upon release of the squeezing force, such walls will distend to their unflexed positions, thereby drawing a partial vacuum in the reservoir, providing for atmospheric pressure to force air into the reservoir to cooperate with the residual fluid to occupy the full volume thereof. Therefore, it is contemplated that the container 22 may be formed from a multiplicity of appropriate materials encompassing a wide range of durability and resiliency, as are known in the art. For example, polypropylene, polyethylene, polyvinylchloride and the like have proven to be suitable materials for the container 22. The material composition of the container 22 is sufficiently rigid so that it may also serve as a handle by which a user may grasp the applicator device 15 and exert adequate inwardly directed force to focus and control the application of treatment fluid to a desired tire surface.

It is contemplated that the squeeze bottle container 22 depicted in the preferred embodiment of FIG. 30 may be disposable and replaceable, containing any number of appropriate treatment fluids for application to a vehicle tire. The user may detach the squeeze bottle container 22 from its complementally mating applicator head 67 (see FIG. 12) and discard it when it has exhausted its supply of fluid, while subsequently replacing the discarded bottle with a new and filled bottle. However, it is also contemplated that the squeeze bottle container 22 may be refillable by way of an outwardly and upwardly extending filling stem (not shown) projecting from the vicinity of the rear extremity of the dorsal wall 26. It is further contemplated that such a filling stem may include a snap on containment cap, a screw top or hinged construction or any other appropriate securement means (not shown) to prevent the escape of fluid from the reservoir 24.

Figure 3:
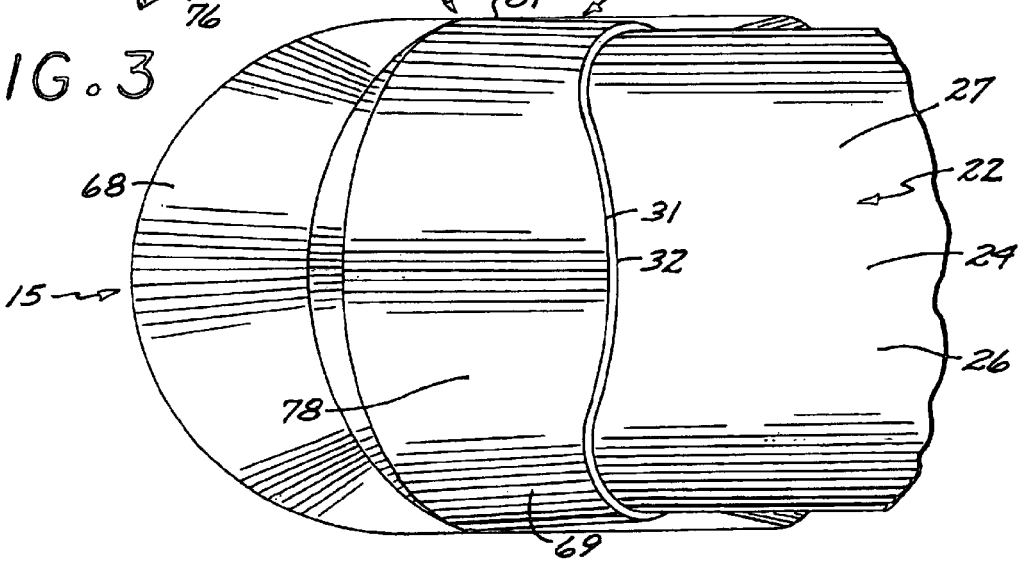
FIG. 3 is a top view of the applicator device shown in FIG. 1.

The exterior surface of the container 22 need not be specifically ergonomically adapted, however, as shown in the exemplary embodiment of FIG. 12, at least the dorsal wall 26 may be shaped and adapted to correspond to the natural curve of a typical user's palm when he or she is grasping the handle 20, while the ventral wall 28 may be similarly shaped and oppositely disposed. In plan view, as shown in FIG. 3, the convex dorsal wall 26 curves gradually outwardly and downwardly to define a palm pad 27 for complemental receipt in the correspondingly concavely curved palm of the user when his or her hand is in a grasping posture. This palm pad provides a pressure surface facing in one direction by which the user may grasp the applicator to exert an appropriate amount of force in the opposite direction for applying treatment fluid to a desired surface. It is further contemplated that other ergonomic features may be incorporated into the container 22 design, to include, for instance, finger grooves (not shown) for receipt of the user's fingers therein.

With focus now on the connection of the container 22 to the dispenser housing 70, as shown in FIGS. 1–3 and 12, the cowling 78 terminates in its rear edge in a scallop configured on its top and bottom sides with rearwardly projecting curved tongues 87 terminating in respective rearward edges 88. In one preferred embodiment of the container, as shown in FIG. 30, a contoured groove is formed about the periphery of the end container wall 31 to define a forwardly facing contoured shoulder 32 curved on its opposite sides to receive in a nesting relationship the respective tongues 87. As also shown in FIG. 30, the end wall 31 of the container 22 may include a neck yoke 33 that extends outwardly from the lower extent of the shoulder 32 to define the portion of the container 22 that is received within the coupling assembly 145 of the housing 70. The yoke 33 is preferably centrally formed with an outwardly projecting neck 45 to be received in cavity 150 of the inlet device 148 (see e.g. FIG. 7). The neck 45 may take any convenient corresponding shape to that of the cavity 150 for complemental receipt therein, and in one preferred embodiment, as shown in FIG. 30, is internally hollowed along its length and cylindrical in shape. It is also contemplated that a bottle cap (not shown), which may take on a multiplicity of structures known in the art, may be releasably secured over the proximal end of the neck 45 to seal against the unwanted flow or evaporation of fluid from the container reservoir 24. The cap may be secured to the neck 45 by any suitable means as are well known in the art, including, for example, female threading in the cap (not shown) that receives male thread segments formed on the neck 45. A user may remove and discard this cap before mating the container 22 with the dispenser housing 70, or may retain it to be placed back on the neck 45 if the container 22 is removed from the applicator head 67 for storage between applications.

With continued reference to the preferred embodiment of FIG. 30, to enable mounting and locking of the container 22 into the inlet device 148 of the dispenser housing 70, the neck 45 is formed with a plurality of radially outwardly projecting locking studs 50. Such studs 50 are annularly arrayed about the neck 45 and spaced apart and sized to snapingly register behind the corresponding lugs 162 in the inlet device 148 and to fit axially through the clearance slots 165 (see FIGS. 10 and 18–19). As shown in FIG. 30, the studs 50 are further configured at their respective free extremities with outwardly and rearwardly angled cam surfaces 51.

In one exemplary embodiment, as shown in FIGS. 10, 18 and 19, the neck may be formed with three such studs 50 for coupling with three corresponding lugs 162 on the coupling shell 154, which are arrayed equidistant thereabout and spaced annularly apart by a distance to define respective clearance slots 165 therebetween, and to receive axially, in clearing relationship, the respective studs 50. As shown in FIGS. 20 and 21, such lugs 162 are configured with radially out turned teeth 163 defining inwardly and forwardly angled, outwardly facing cam surfaces 164 configured to slidingly engage the cam surfaces 51 of the studs 50 for axial shifting relative thereto and flexing to provide for axial travel sufficient to register the studs 50 behind the lugs 162 in locking relationship as shown in FIG. 21. To releasably connect the container 22 to the housing 70, the bottle neck 45 will be received in the annular cavity 150, and over the inlet boss 160 that may be included in the second embodiment, such that, with the studs 50 engaged securely behind respective lugs 162, the distal portion of the bottle neck 45 will be seated against neck abutment surface 157, as is shown in FIGS. 7 and 13.

So configured, the bottle neck 45 will be securely seated in inlet device 148 in a close fit relationship to provide a fluid tight sealing engagement between the container 22 and the housing 70. As shown in FIGS. 7 and 13, with the rearward edges 88 of the cowling tongues 87 nested against the forwardly facing shoulder 32 of the end wall 31 of the container 22, the neck yoke 33 received in the coupling assembly 145, the neck 45 seated against the abutment surface 157, and the studs 50 registered securely behind respective lugs 162, the container 22 will be securely registered within the housing 70 to hold its rotary position therein.

To release the container 22 from the dispenser housing 70 and its coupling assembly 145, either the cowling 78 and/or the cowling tongues 87 (see e.g. FIG. 2) or the yoke 33 or end wall 31(FIG. 30), or all of these elements, may be constructed of a material sufficiently flexible to permit sufficient limited axial rotation of the container 22 and the cowling 78 relative to one another to disengage the complemental mating of the forwardly facing shoulder 32 of the container 22 and the rearward edges 88 of the curved cowling tongues 87. This simultaneously rotates the bottle neck 45 within the coupling shell 154 from the position shown in FIGS. 10 and 18, with the studs 50 snapingly engaged behind corresponding lugs 162, until the locking studs 50 are aligned with respective clearance slots 165, as shown in FIG. 19. The user may then withdraw the studs 50 axially through the slots 165 to effectuate a separation of the neck 45 from the inlet device 148. It is also contemplated that, to disengage the container 22 from the housing 70, the cowling 78 and container 22 may be manufactured such that, when the yoke 33 is received in the cowling 78 and the cowling tongues 87 are aligned with the container shoulder 32, there is sufficient clearance between the shoulder and the tongues and the yoke and the cowling to permit limited axial rotation of the container 22 relative to the housing 70.

While a snap lock type connection has been described, it is contemplated that any appropriate connection means, such as a threaded engagement, bayonet fit, or a clamp type connection may be employed in the coupling assembly 145 to facilitate coupling of the container 22 to the dispenser housing 70. For example, the coupling shell 154 may be configured with a peripheral connector bead section (not shown) while the bottle neck 45 is formed with an exterior conically shaped flange (not shown) for snapping behind this connector bead section. It is also contemplated that female threading in the coupling shell 154 may receive male threads formed on the neck 45, or that in embodiments incorporating an inlet boss 160, male threads on the periphery of the inlet boss 160 may be received in female threading on the interior of the neck 45. Additionally, while the container 22 has been shown as including a projecting tubular neck 45 for receipt in the coupling assembly 145 of the housing 70, it will be appreciated by those skilled in the art that the term neck is intended to include any opening in the container, including a recessed tubular element, it only being important that the construction of the neck permit complemental mating of the housing 70 and the container 22.

In operation, it will be appreciated that the applicator of the present invention will typically be sold at a retail level in a package including the applicator head 67 and container 22, possibly along with one or two replacement containers. The replacement containers will typically be closed by a cap (not shown) releasably connected to the container's neck 45 by any suitable means known in the art. To assemble the applicator device 15, the user will mount a chosen container 22 in the applicator head 67 by generally inserting the yoke 33 and end wall 31 of the container 22 into the coupling assembly 145 of the housing 70. More specifically, the snap lock construction included in the coupling shell 154, as shown in FIGS. 20 and 21, permits the user to seat the container neck 45 in the inlet device 148 in a close fit, fluid tight sealing relationship, by inwardly advancing the bottle neck 45 through the cavity 150 within the coupling shell 154, and over the inlet boss 160 if present as in the second embodiment, until the neck studs 50 are snapingly engaged behind respective lugs 162 and the distal extent of the bottle neck 45 is seated against the neck abutment surface 157. This serves to also align the mating curvilinear rearward edges 88 of the cowling tongues 87 with the forwardly facing shoulder 32 of the end wall 31 as shown in FIGS. 1–2 and 12, while the yoke 33 and end wall 31 are seated in the coupling assembly 145 and the neck 45 is received in the inlet device 148 as described above and shown in FIGS. 7 and 13.

When the user undertakes to use the applicator, he or she will grasp the container 22, hold the applicator head 67 down, and either shake such container or exert inwardly directed compressive force on the walls thereof to reduce the volume of the reservoir, applying pressure to the applicator fluid therein to drive such fluid downwardly out of the container neck 45. In the embodiment shown in FIG. 7, the pressure with which the fluid exits the container 22 and the air that is forced from the container will in turn force the fluid through the valve 133 of the flow control 132. As further pressure is applied thereto, the valve's domed shape will be deflected downwardly in the center, thus flaring the proximate corners of the leaves 138 downwardly, thereby opening the slits 136 and providing for a flow of treatment fluid into the flow chamber 71 portion of the fluid communication path 130. The flow chamber 71 may take on any suitable width and shape, depending on the viscosity of the treatment fluid and its flow characteristics, to efficiently direct the fluid downwardly therethrough, and then through the distribution plate 75, distribution surface 76 and distribution opening 77, to be deposited on the attachment surface 56 of the applicator pad 55. Some of the deposited fluid will then begin to flow through the applicator pad. Additionally, due to the downwardly curving shape of the distribution surface 76, the remainder of the fluid will be urged through the channel 91 to flow forwardly and rewardly therein, as shown in FIGS. 7 and 8, so that fluid is distributed across the longitudinal dimensions of the applicator pad 55. The porosity or material composition of the pad will then facilitate the passage of the fluid from the pad's attachment surface 56 to the working surface 62. In embodiments such as shown in FIG. 15, the fluid will also flow through the channels 92 to be distributed across the lateral dimensions of the pad before passing therethrough to the working surface.

In the embodiment shown in FIG. 13, wherein the flow control 132 is situated in the distribution plate 75, after pressure applied to the container 22 drives the fluid downwardly out of the container neck 45, it will travel along the fluid communication path 130 and downwardly into the flow chamber 71. In this regard, it will be appreciated that the by pointing the housing 70 downwardly, the fluid will flow into the flow chamber 71 and along the communication path 130, which will apply pressure to the flow control valve 133. With the flow chamber 71 filled, along with the inlet boss 160 if present in the embodiment, by compressing the walls of the container 22 and reducing the volume therein, pressure will be applied to the fluid in the flow chamber 71, thus tending to force it downwardly through control valve 133 disposed in the distribution plate 75 (FIG. 13). As further pressure is applied thereto, the valve's domed shape will be deflected downwardly in the center, thus flaring the proximate corners of the leaves 138 downwardly, thereby opening the slits 136 and providing for a flow of treatment fluid downwardly through the distribution plate 75 and distribution surface 76' to the applicator pad attachment surface 56. A portion of the deposited fluid will then begin to flow through the applicator pad 55', while the remaining fluid begins to flow through the channel 91' to flow forwardly and rewardly therein, as shown in FIG. 15, and laterally through distribution branches 92, so that fluid is distributed across the lateral and longitudinal dimensions of the applicator pad 55' for passage therethrough to the concave working surface 62.

Figure 25:
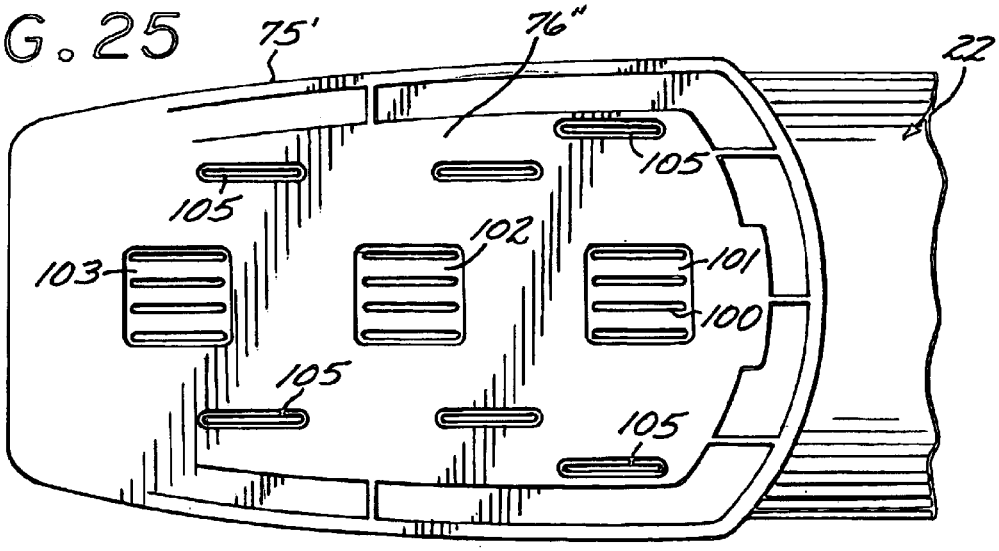
FIG. 25 is a horizontal sectional view taken along line 25—25 of FIG. 22.

As shown in FIG. 25, the user will then grasp the container handle 22 to gain favorable purchase of the applicator 15 and may move the handle as desired to pass the head 67 of the applicator 15 across the convex curving surfaces of a tire, thus applying fluid reaching the underside working surface 62 to the tire's sidewalls. The handle container 22 serves to extend the reach of the applicator 15. While the dimensions may be varied, in practice, the applicator head 67 is about 3½ inches long and the container 22 is about 6 inches long to provide an overall axial reach of over 9 inches. By grasping the container 22 and engaging the concave working surface 62 of the applicator pad 55 with the convex curving surfaces of a tire, and by thrusting the tapered head axially or in a circular motion along the tire's sidewall, the operator may conveniently access and efficiently apply fluid evenly across a desired curving tire surface. In embodiments wherein the working surface 62 of the pad and/or distribution surface 76 are generally planar, the user will engage the working surface 62 with the convex curving tire sidewall and press the working surface inwardly towards the tire, which in turn will cause the pad to flex and cooperate with the working surface 62 to conform to the shape of the convex curving sidewall. This will permit the user to evenly spread the desired fluid onto the tire by applying a substantially even pressure across the length of the curved sidewall surface.

It will be appreciated that, when the pad 55 is engaged with the tire sidewall, that the user may exert further pressure on the applicator head 67 to facilitate the tendency to force the liquid through such pad 55 to the working surface 62 and to the tire sidewall. It will also be a appreciated that, if the user wishes to apply focused and more concentrated perpendicularly directed force to the pad 55 or 55' for hard to clean or treat tire surfaces, he or she may grasp the applicator 15 by the dispenser housing 70 from the top side thereof, applying the palm of his or her hand to the domed surface of the cowling 78 and housing shell 69. The user may also grasp the side walls, 80 and 81, with the fingers of his or her grasping hand being comfortably positioned therealong. When the initial charge of fluid dispensed has been depleted, the user may thereupon again squeeze the container 22 or otherwise repeat the above described sequence.

When the procedure is completed, the user may easily disconnect the container 22 from the dispenser housing 70 and coupling assembly 145 by twisting the container 22 to rotate container end wall 31 within the cowling 78. The flexibility of the cowling, curved tongues 87 and/or yoke 33 and end wall 31 will permit limited axial rotation to skew the alignment between the end wall 31 of the container 22 and the curved tongues 87 of the cowling 78, thereby disengaging the forwardly facing shoulder 32 of the container 22 from the rearward edges 88 of the tongues 87. This simultaneously permits the user to similarly axially rotate the neck 45 slightly within the coupling shell 154 and cavity 150 from the position shown in FIG. 18, with the studs 50 snapingly engaged behind respective lugs 162, until the locking studs 50 are aligned with respective clearance slots 165, as shown in FIG. 19. The user may then withdraw the studs 50 through the slots 165 to disengage the neck 45 from the inlet device 148 and the yoke 33 from the coupling assembly 145 to effectuate a separation of the container 22 from the housing 70.

A cap (not shown) may then be replaced on the neck 45 of the container 22 to be stored until the next use, and, if desirable, the applicator pad 55 may be cleaned or washed in a cleaning fluid, such as tap water. The container 22 and applicator head 67 may then be readily assembled for the next usage, or when the fluid in such container becomes diminished, the container 22 may be discarded and a new replacement container 22, already charged with a desired fluid, may be selected and secured in the dispenser housing 70 as set forth above. It is contemplated that the user may replace the depleted container with another container having the same, or a different, cleaning, rubber conditioning or other tire treatment fluid.

Turning now to an alternate embodiment as depicted in FIGS. 22–25, it is also contemplated that a distribution plate 75' may be formed with a plurality of through flow openings 100 arrayed across the longitudinal and lateral extent thereof. As shown in FIGS. 22 and 23, in such an embodiment, a housing 70' is formed with a flow chamber 71'. The flow chamber 71' may also include a multiple chamber internal construction, being divided into a plurality of chambers, for example two, or, in the embodiment depicted in FIG. 23, a central introduction chamber 72 may be disposed between a pair of flanking chambers 73. However, it is also contemplated that the fluid may pass through the flow chamber 71' to a distribution manifold (not shown), which in turn distributes fluid to a plurality of transfer channels for distributing the fluid across the dimensions of the attachment surface 56 for further transfer through the applicator pad 55' to its working surface 62.

With continued reference to the embodiment depicted in FIG. 23, in a tripartite multiple chamber embodiment, the flow chamber 71' may be configured with a pair of elongated laterally spaced apart ribs, 82 and 83. In this embodiment, the housing 70' includes a rear wall 85, and the ribs, 82 and 83, emanate from the rear wall 85, projecting forwardly to form the centrally disposed introduction chamber 72 and to terminate at their respective forward extremities in respective outlet edges 93 and 94. Within the flow chamber 71', these ribs, 82 and 83, not only define the lateral extent of the introduction chamber 72, but their lateral edges also define the inner walls of a pair of laterally spaced apart flanking chambers 73 having the introduction chamber 72 disposed therebetween. The top surface of the distribution plate 75' defines the bottom surface of the flow chamber 71' and any other chambers included therein.

In the embodiment depicted in FIG. 22, the introduction chamber 72 angles downwardly and forwardly from the proximal extremity of the housing 70' to terminate near the distal extremity, but may extend in any appropriate angle or configuration to facilitate the desired distribution of fluid through various locations in the distribution plate 75'. While fluid distribution to the distribution plate 75' will generally be influenced by the pressure created by inwardly directed compressive forces on the walls of the container, the longitudinal alignment of the introduction chamber 72 may also influence the flow path of the fluid to the distribution plate 75'. For example, a greater downward and forward angling introduction chamber 72 permits the fluid to flow more to the distal extremity of the housing 70', while a lesser downward and forward angling permits the fluid to flow more predominantly to the vicinity of the proximal extremity. With reference to the embodiment of FIG. 23, the distribution plate 75' is formed with selected arrays of flow openings 100, which are strategically placed to distribute a metered and relatively predictable amount of treatment fluid therethrough to the applicator pad 55'. In FIG. 23, the openings appear as elongated slots 100, but may take any convenient shape or dimension to accommodate the material characteristics of the product being dispensed or the contours of the desired tire surface. For instance, more viscous fluids will require larger openings.

A plurality of slots, generally designated 100, are arrayed in the distribution plate 75' and may be grouped in a first, second and third set of longitudinally spaced apart slots, 101, 102 and 103 respectively, which are generally situated in the introduction chamber 72 near the central region of the dispenser housing 70'. As will be appreciated by those skilled in the art, such relatively closely spaced and clustered slots, as shown in FIG. 23, are so configured to provide for the dispensation of a relatively robust quantity of fluid located generally centrally over the applicator pad 55' in the wider area thereof so as to afford a relatively robust quantity of dispensed fluid in that wide area for distribution and application to the desired tire surface. The flanking chambers 73 may be formed with a plurality of slots 105 for providing for a relatively more modest flow of fluid in the lateral portions of the wider segment of the applicator pad 55'. It is contemplated that in one preferred configuration, these slots may be approximately 1/16" wide and 3/8" long for optimal use in conjunction with a commercially available multi purpose tire treatment fluid sold by Eagle One Industries, of Carlsbad, Calif., under the trade designation WET Tire Shine™. Other suitable treatment fluids may require appropriate adjustment in the dimensions of the slots 100 for optimal flow characteristics therethrough based on the material composition of the selected fluid.

The distribution plate 75' may be formed such that the openings 100 extend from the upper surface of the plate and terminate at a distribution surface 76". In such an embodiment, the applicator pad attachment surface 56 is strategically connected to the distribution surface 76" throughout its surface area by adhesive or other suitable affixation means known in the art, ensuring that the affixation means does not clog or otherwise occlude the openings 100. To further ensure that the openings will not be occluded by the adhesive or other affixation means, the distribution surface 76" of the distribution plate 75' may be recessed, as shown in FIGS. 24 and 25, so that the openings 100 terminate in the distribution surface 76" of the distribution plate 75' at a point spaced apart from and above the pad attachment surface 56. It is further contemplated that the outer perimeter of the bottom surface of the distribution plate 75' may be formed with a downwardly projecting mounting ridge (not shown) for affixation of a corresponding in area portion of the perimeter of the applicator pad attachment surface 56 thereto.

With focus now on the internal construction of the housing 70' in the alternate embodiment shown in FIG. 22, it is also keeping with the invention that the rear dispenser housing wall 85 may be formed with a coupling assembly 145' including a mounting socket 111 for complemental mating with the yoke 33 and neck 45 of the container 22. The mounting socket 111 is formed with an inlet device 148' including a tubular inlet bore 112 that extends forwardly and downwardly through the rear wall 85 and maintains fluid communication with the flow chamber 71'. The inlet bore 112 is formed with at a bore abutment ridge 114 extending inwardly from the walls of the bore 112 and defining a transition between the distal extent of the inlet bore 112 and the proximal extent of the flow chamber 71'. In FIG. 22, the flow control 132 is depicted as being located at this transition, however, it may be located at any point along fluid communication path 130 from the container 22 to the applicator pad 55'. As shown in FIG. 22, when the container 22 is received in the inlet bore 112, the distal extremity of the bottle neck 45 will be abutted against this abutment ridge 114. In such an embodiment, the abutment ridge 114 is annular in shape, having a central opening 159 defining a portion of the fluid communication path 130 for passing the fluid therethrough from the container 22 and its neck 45 to the flow chamber 71'.

As set forth in the above described embodiments and shown in the exemplary depiction at FIGS. 18–21, the inlet bore 112 may also be further formed in its proximal region with a plurality of lugs 162 spaced apart to define clearance slots 165 therebetween (such as shown in the exemplary embodiment of FIGS. 18–19) such that the studs 50 of the container neck 45 will be snapingly engaged behind respective lugs 162 (FIG. 21) in the bore 112 to secure the container 22 to the housing 70' and its coupling assembly 145'. While a snap lock connection has been described, it is further contemplated that any appropriate connection means, such as a threaded engagement or a clamp type connection, may also be employed to facilitate coupling of the container 22 to the dispenser housing 70'.

In operation, the user will secure the container 22 in the coupling assembly 145' of the dispenser housing 70' by aligning the yoke 33 and end wall 31 in the mounting socket 111 and seating the container neck 45 in the inlet bore 112 to thereafter inwardly advance the neck 45 through the inlet bore 112 in an alignment such that the locking studs 50 will be secured behind respective lugs 162 as set forth above. This will also result in the alignment of the mating curvilinear surfaces of the cowling 78 and the container end wall 31. As shown in FIGS. 22–23, by squeezing inwardly the walls of the container 22, a user will then cause the fluid therein to flow from the container reservoir 24, through the inlet bore 112 and bottle neck 45, and to the flow chamber 71', and more specifically, to the outwardly and forwardly angled rear portion of the introduction chamber 72. This initially directs the flow of fluid over the rear most array of slots 101 into contact with the longitudinally medial portion of the distribution plate 75', and will further effect flow through the second set of slots 102 for dispensation therethrough. Fluid flow will then continue to the more forwardly positioned slots 103. The fluid flow, under continued pressure from the squeezed container 22, will then continue forwardly and spread laterally across the forwardly disposed respective outlet edges 93 and 94 of the corresponding ribs 82 and 83 to flow laterally, outwardly and rearwardly into the respective flanking chambers 73, to then be driven rearwardly under pressure to flow over the slots 105 to thus dispense a measured modest amount of fluid to the lateral most portions of the distribution plate 75'.

Additionally, while FIG. 22 depicts the distribution plate 75' as having a generally planar distribution plate 75' and distribution surface 76", it is also contemplated that these may be downwardly and outwardly curved in a concave manner and specifically designed to complementally receive the outwardly curving, convex outer surfaces of a wide variety of vehicle tires. In such a configuration, when the fluid is deposited on the distribution plate 75' from the introduction chamber 72, the concave curvature of the distribution plate 75' and surface 76" will further assist in promoting the fluid to flow towards the forward portion of the introduction chamber 72 and into the flanking chambers 73.

Figure 31:
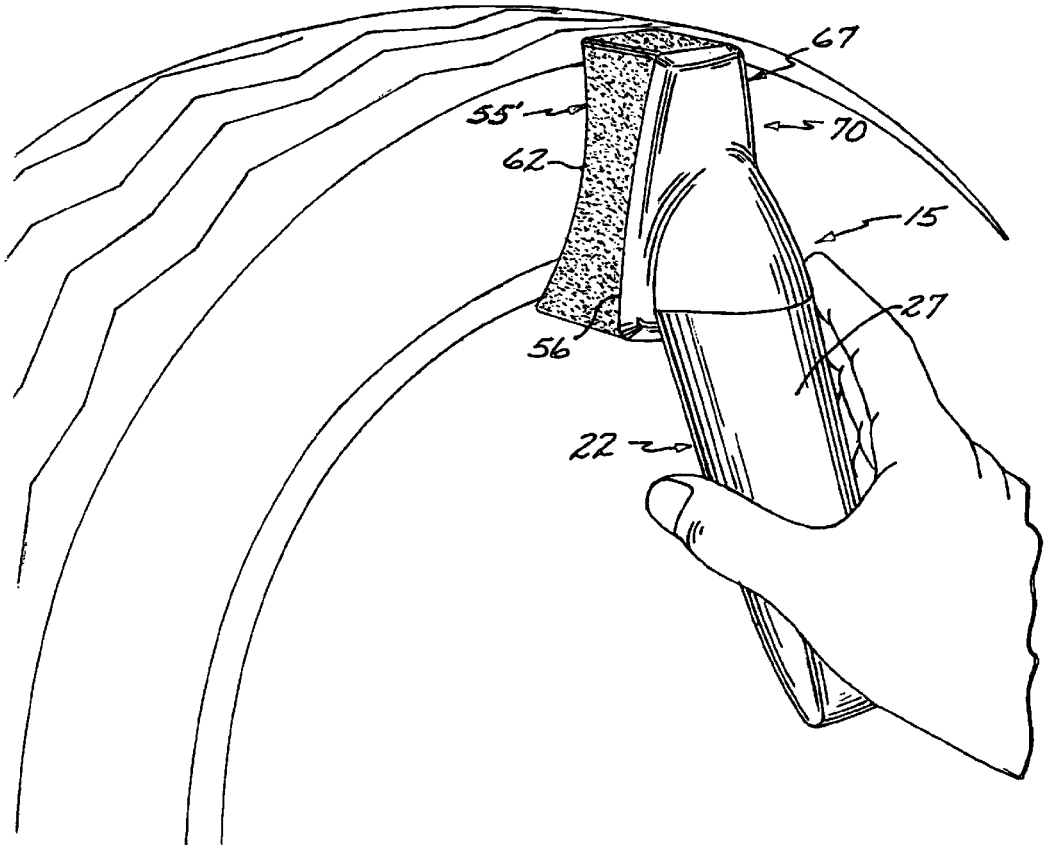
FIG. 31 is a perspective view, showing the applicator device of FIG. 12 in contact with a tire sidewall.

With reference to FIGS. 24 and 25, as the fluid is forced to the various slots 100–105 of the distribution plate 75', it then continues through such slots to distribution surface 76", which may be recessed and spaced apart from the applicator pad 55' to prevent occlusion of the slots. The fluid will then flow to the attachment surface 56 of the applicator pad 55', and then through the applicator pad or its through channels 59 to be dispersed on the applicator's concave working surface 62. The user then may pass the applicator head 67 across the surface to be treated thus applying the underside concave working surface 62 of the pad 55' to the complementally mating convex curving surfaces of a tire sidewall, as shown in FIG. 31. When the readily available supply of fluid at the working surface 62 has depleted, the user may thereupon squeeze the container 22 or otherwise again repeat the above described sequence. After treatment of a desired surface is completed, or the fluid in the container 22 has been exhausted, the user will disengage the container 22 from the housing 70 by twisting the container to axially rotate the yoke 33 and the coupling assembly 145' relative to one another. The flexibility of the cowling 78, yoke 33 and container end wall 31 will permit this limited axial rotation to skew the alignment between the cowling 78 and container end wall 31, which will serve to similarly axially rotate bottle neck 45 in inlet bore 112 to align the studs 50 with a corresponding clearance slot 165. The user may then withdraw the studs 50 through the clearance slots 165 to effectuate release of the container 22 from the housing 70', and replace the container 22 as set forth above.

While a squeeze dispensing embodiment of the container 22 of the present invention has been described in detail, it is also in keeping with the invention to choose a material for the container having relatively more rigid walls, thereby requiring the user to vertically elevate the container 22 and handle 24 portion of the applicator 15 above that of the housing 70 in order to initiate the flow of fluid into the housing 70 and applicator pad 55. Further, the handle may not necessarily be defined by the container 22, but may be formed as one of two or more components. For example, the handle may be in the form of an open top channel shaped member, while the container may be in the form of a flexible bottle, tube or other packaging devices readily known to those skilled in the art wherein the volume can be varied as by flexing the wall or rolling up the tube or depressing a plunger. Additionally, while the container neck 45 has been described as having a plurality of studs 50 for snapping engagement behind a corresponding plurality of lugs 162 as may be formed in the coupling shell 154, inlet device 148, inlet bore 112 or socket 111, it is contemplated that coupling of the container 22 to the housing 70 may also be accomplished by one such stud being received behind one such lug, or by any other convenient coupling construction as is known in the art. Further, while the applicator pad working surface 62 is ideally concavely curving to complementally receive the convex curvature of a typical vehicle tire sidewall, it is contemplated that the working surface 62 may be formed with any appropriate shape or curvature to treat any variety of surfaces as may be present in a vehicle tire, or that the working surface may be generally planar.

While several particular forms of the invention have been illustrated and described, it will also be apparent to those skilled in the art that various modifications can be made without departing from the spirit and scope of the invention. Accordingly, it is not intended that the invention be limited except by the following claims.

What is claimed is:

1. A tire applicator for applying cleaning or other surface treatment fluid to the convex curving sidewall of a tire comprising:

a housing formed with a flow chamber and including a coupling assembly that includes an inlet to the chamber and a first connector element, the housing further being formed on one side with a distribution plate through which is formed an outlet for communicating fluid from the flow chamber to an outwardly facing distribution surface;

an elongated pad mounted on one side to the distribution surface at an interface and formed on its opposite side with a concave working surface to complementally fit the convex curving sidewall, the pad further being porous for flow of fluid therethrough to the working surface;

a container including a second connector element releasably engagable with the first connector element and an outlet neck for receipt in the coupling assembly to engage in the inlet;

a fluid distribution device interposed at the interface and in fluid communication with the outlet to distribute the fluid longitudinally along the pad; and a flow control device for regulating the flow of fluid to the distribution surface.

2. The applicator of claim 1 wherein:

the fluid distribution device is further configured to distribute the fluid laterally along the pad.

3. The applicator of claim 1 wherein:

the flow control device includes a valve.

4. The applicator of claim 1 wherein:

the flow control device includes a one way valve responsive to a predetermined pressure in the flow chamber to provide for fluid flow therethrough.

5. The applicator of claim 1 wherein:

the inlet includes a tubular boss in communication with the flow chamber; and the neck of the container is constructed to be telescopically received over the boss.

6. The applicator of claim 1 wherein:

the neck of the container includes at least one stud defining the second connector element; and the inlet includes the first connector element which is formed with at least one lug for connecting with the at least one stud.

7. The applicator of claim 6 wherein:

the first connector includes at least one clearance slot corresponding in shape to that of the at least one stud; and the neck is constructed so the container may be grasped to rotate the neck to align the at least one stud with the clearance slot for axial withdrawal therethrough to release the second connector element from the first connector element.

8. The applicator of claim 1 wherein:

the inlet is formed with a coupling shell that is formed with an annular cavity and a coupling wall that defines an abutment surface, the coupling shell further including at least one lug defining the first connector element; and the neck is received in the annular cavity with the neck abutted against the abutment surface and includes at least one stud defining the second connector element for connecting with the at least one lug.

9. The applicator of claim 1 wherein:

the first and second connector elements are constructed to allow rotation of the container about a rotational axis relative to the housing, and upon such rotation, the first connector element will be disengaged from the second connector element.

10. The applicator of claim 1 wherein:

the coupling assembly includes a cowling configured on at least one side with a tongue terminating in a registration edge; and the container includes an end wall configured with a shoulder facing such cowling to compliment the shape of the edge to abut thereagainst to register the container relative to the housing.

11. The applicator of claim 1 wherein:

the coupling assembly includes a cowling configured to receive the container in close fit relationship to resist rotation thereof, and is sufficiently flexible to, upon application of predetermined rotational forces thereto, permit limited rotation thereof.

12. The applicator of claim 11 wherein:

the first and second connector elements are constructed so that the container can be rotated relative to the housing to disengage the elements from one another.

13. The applicator of claim 1 wherein:

the housing includes a flexible cowling projecting toward the container and configured to complementally engage the container to resist rotation of the container relative to the housing, the cowling being sufficiently flexible to flex and, upon predetermined rotational forces being applied to the container, permit rotation of the container relative to the housing.

14. The applicator of claim 1 wherein:

the distribution device includes at least one longitudinally extending distribution channel.

15. The applicator of claim 14 wherein:

the at least one longitudinally extending distribution channel is further formed with a plurality of laterally outwardly extending distribution branches.

16. The applicator of claim 1 wherein:

the pad includes a plurality of channels extending from the interface through the pad to facilitate the flow of fluid to specific desired points on the working surface.

17. The applicator of claim 1 wherein:

the container and the housing are configured for complemental mating to releasably hold the container against rotation about a rotational axis from a first rotational position with the first and second connector elements in axial alignment with one another, and further configured to, upon application of rotational forces thereto, permit the container to be rotated about the axis to move the first and second connector elements out of axial alignment.

18. The applicator of claim 1 wherein:

the distribution device includes a distribution manifold connecting a plurality of channels that extend laterally outwardly in the distribution plate and distribution surface.

19. The applicator of claim 1 wherein:

the distribution plate includes a plurality of flow openings arrayed about the lateral and longitudinal dimensions of the plate to define the distribution device and outlet.

20. The applicator of claim 1 wherein:

the flow chamber is formed adjacent to the inlet and further comprises a pair of laterally spaced apart, longitudinally extending distribution ribs defining a central introduction chamber therebetween and respective laterally flanking chambers in fluid communication with such central introduction chamber.

21. The applicator of claim 20 wherein:

the distribution plate defines a bottom surface of the central chamber and the flanking chambers and includes a plurality of flow openings arrayed thereabout to define the distribution device and outlet.

22. The applicator of claim 21 wherein:

the distribution plate is formed with at least a central set of elongated flanking flow openings spaced longitudinally along the central introduction chamber, and at least one elongated flow opening formed in each of the flanking chambers.

23. The applicator of claim 1 wherein:

the container includes an end wall formed with the neck; and the coupling assembly includes a mounting socket for receiving the end wall therein, the mounting socket being formed with an inlet bore for telescopic receipt of the neck.

24. The applicator device of claim 23 wherein:

the inlet bore is formed with an abutment ridge for abutting the neck thereagainst when the container is received in the housing.

25. A tire applicator for applying treatment fluid to the convex curving sidewall of a tire comprising:

a distribution housing formed with a flow chamber and including a coupling assembly that includes an inlet to the chamber and a first connector element, the housing being formed on one side with a distribution plate having an outwardly facing concave distribution surface formed to complementally fit the convex curving sidewall and configured with at least one outlet opening from the chamber;

an elongated pad mounted on the distribution surface at an interface and formed with a working surface, the pad further being porous to flow fluid therethrough to the working surface;

a container including a second connector element and an outlet neck for receipt in the coupling assembly to engage in the inlet;

a fluid distribution device interposed at the interface and in fluid communication with the outlet to distribute the fluid from the outlet longitudinally along the pad; and a flow control device for regulating the flow of fluid to the distribution surface.

26. The applicator of claim 25 wherein:

the distribution device is further constructed to distribute the fluid laterally on the applicator pad.

27. A tire applicator for applying treatment fluid to the convex curving surface of a tire sidewall comprising:

a housing head having a front and rear extremity and including a distribution plate formed with a distribution surface, a receiver opening upwardly toward the rear extremity and a flow passage leading from the receiver to the distribution surface, the receiver being further formed with a first connector;

the distribution plate further including a longitudinal distribution channel in communication with the passage and opening into such distribution surface;

an elongated applicator pad mounted on one side to the distribution surface and formed on its opposite side with a working surface, the pad being constructed to, when such plate is pressed toward the convex tire sidewall, flex and cause the working surface to complementally fit such sidewall, the pad further being porous for flow of the fluid from the channel to the working surface;

a one way valve located along a fluid flow path extending between the container, the receiver and the flow passage for controlling the flow of fluid therethrough;

a flexible wall fluid package including a neck receivable in the receiver and including screw thread segments releasably engagable with a screw cap received on the neck and a second connector releasably engagable with the first connector whereby the fluid may be packaged in the package, the cap may be removed and the neck may be inserted in the receiver to couple the second connector with the first connector such that upon squeezing of such flexible wall, the fluid will be flowed along the fluid flow path, through the valve and to the distribution channel for flow therealong and passage from the one side of the pad to the working surface.

28. The applicator of claim 27 wherein:

the package is formed with a shoulder; and the head includes a cowling projecting toward the package and terminating in abutment edges engaging the shoulder to cooperate with the neck and receiver in supporting the package relative to the head.

29. The applicator of claim 27 wherein:

the distribution surface is formed with a concave shape formed to complement the convex curving surface of the tire sidewall.

30. The applicator of claim 27 wherein:

the plate includes at least one lateral distribution channel in communication with the longitudinal distribution channel.

31. A tire applicator for applying treatment fluid to the convex curving surface of a tire sidewall comprising:

an applicator head having a front and a rear extremity and formed with an interior flow chamber for receiving the treatment fluid and an exterior hand pressure surface facing in one direction, the head further including an elongated distribution plate formed with a passage means for passing the fluid therethrough to a distribution surface facing in the opposite direction and an inlet device in communication with the chamber that is formed with a first connector element, the distribution surface defining a saddle shape to complementally fit the convex curving surface of the tire sidewall;

a fluid container for storing the fluid and including a neck for receipt in the inlet device and a second connector element for connecting with the first connector to releasably secure the container in the applicator head;

a flexible porous pad affixed to the distribution surface to define an interface and including a working surface facing in the opposite direction, the pad being constructed to, upon the hand pressure surface being grasped by a user, engage such working surface with the tire sidewall for the application of a selected force in the opposite direction toward the sidewall to flex the pad to cooperate with the working surface and conform it to the convex contour of the tire sidewall;

a flow device to be activated by the user to drive the fluid to flow along a fluid communication path defined by the container neck, the inlet device, the flow chamber and the distribution plate and the passage means; and a distribution device interposed at the interface for receiving the fluid from the passage means and including at least one longitudinal channel for distributing the fluid longitudinally along the applicator pad, the pad being sufficiently porous for communicating the fluid therethrough to the working surface.

32. The applicator of claim 31 wherein:

the pad is pre-formed with the working surface defining a saddle shape to complementally fit the convex curving surface of the tire sidewall.

33. A method of using an applicator for applying treatment fluid to the convex curving sidewall of a vehicle tire comprising:

selecting an applicator device including a flexible wall container containing the treatment fluid, a hand pressure surface facing in one direction, a housing releasably mounting the container and including a distribution plate formed with a distribution surface facing in the opposite direction, a fluid communication path formed between the container and the distribution surface, a one-way flow control device for controlling the flow of fluid along the fluid communication path, a flexible applicator pad attached on one side to the distribution surface at an interface and being sufficiently porous to flow fluid therethrough to an opposite side formed with a working surface facing in the opposite direction, and a distribution device interposed at the interface for distributing the fluid from the distribution surface across the area of the one side of the pad;

flexing the flexible wall container to cause the fluid to flow under pressure along the fluid communication path from the container, through the flow control device, and through the distribution surface to the distribution device to be distributed about the area of the pad and flow therethrough to the working surface; and treating the tire sidewall by grasping the hand pressure surface facing in the one direction, engaging the working surface with the tire sidewall and applying a selected force in the opposite direction toward the sidewall, thereby causing the working surface to flex and cooperate with the pad to conform to the convex contour of the tire sidewall for application of fluid from the working surface to the sidewall.

34. The method of claim 33 including:

selecting the flexible wall container having the hand pressure surface formed thereon.

35. The method of claim 33 including:

selecting the housing head with the hand pressure surface formed thereon.

36. A tire applicator for applying treatment fluid to the convex curved sidewall of a tire comprising:

a housing formed with a flow chamber and including a coupling assembly forming an inlet to the chamber and a first connector element, the housing being formed on one side with an outlet to an outwardly facing concave distribution surface formed to complementally fit the convex curving sidewall;

an elongated pad mounted on the distribution surface confronting the outlet and formed with an outwardly facing working surface, the pad further being porous to flow fluid therethrough to the working surface;

a container including an outlet neck for receipt in the coupling assembly to engage in the inlet and a second connector element cooperating with the first connector element to couple the container to the housing; and a flow control device for regulating the flow of fluid to the outlet for flow through the pad to the working surface.

37. The applicator of claim 36 wherein:

the first connector element and second connector element are defined by respective screw threads configured for mating rotational engagement.

* * * * *